US007594721B2

(12) United States Patent
Belbey et al.

(10) Patent No.: US 7,594,721 B2
(45) Date of Patent: Sep. 29, 2009

(54) SHEET EJECTING

(75) Inventors: Jason S. Belbey, Vancouver, WA (US); Steve O. Rasmussen, Vancouver, WA (US); Robert M. Yraceburu, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 529 days.

(21) Appl. No.: 11/263,136

(22) Filed: Oct. 31, 2005

(65) Prior Publication Data

US 2007/0096391 A1 May 3, 2007

(51) Int. Cl.
*B41J 2/01* (2006.01)

(52) U.S. Cl. ..... 347/104; 347/101; 347/16

(58) Field of Classification Search ..... 347/101, 347/104, 16; 400/644, 641; 399/398, 399; 271/18, 126, 275, 285
See application file for complete search history.

(56) References Cited

U.S. PATENT DOCUMENTS 3,820,776 A * 6/1974 Fujimoto et al. ..... 271/308
4,437,659 A 3/1984 Caron et al.
4,660,825 A 4/1987 Umezawa
4,660,964 A * 4/1987 Yoshikawa et al. ..... 355/28
5,130,758 A * 7/1992 Takeda et al. ..... 399/304
5,217,220 A 6/1993 Carlson et al.
5,355,156 A * 10/1994 Balzeit et al. ..... 346/138
5,500,726 A 3/1996 Aoyama et al.
5,617,197 A 4/1997 Kawabata et al.
5,623,720 A 4/1997 Howe et al.
5,659,863 A 8/1997 Kawabata et al.
5,820,275 A 10/1998 Crawford et al.
5,971,393 A 10/1999 Vernackt
6,050,683 A 4/2000 Nuita et al.
6,092,894 A 7/2000 Nuita et al.
6,658,229 B2 * 12/2003 Ando et al. ..... 399/323

* cited by examiner

*Primary Examiner*—Matthew Luu
*Assistant Examiner*—Henok Legesse

(57) ABSTRACT

Various embodiments and methods are disclosed for sheet ejecting in which a claw boost the twain positions and response to engagement of a cam follower with a cam and in which the cam follower is movable between a cam engaging position at a cam disengaging position.

29 Claims, 11 Drawing Sheets

ACTUATION MECHANISM
CONTROLLER
20
52
50
38
40
41
28
42
22
36
F
C
34
24
56
46
44
30

ACTUATION MECHANISM
CONTROLLER
20
52
50
38
40
41
30
60
28
42
22
44
36
F
C
34
24

ACTUATION MECHANISM
CONTROLLER
52
20
38
40
41
44
30
50
62
28
22
42
F
36
C
34
24

SHEET EJECTING

CROSS-REFERENCE TO RELATED PATENT APPLICATIONS

The present application is related to co-pending U.S. patent application Ser. No. 11/263,130 filed on the same day herewith by Jason S. Belbey, Steve O. Rasmussen and Robert M. Yraceburu, and entitled MEDIA EJECTION SYSTEM, the full disclosure of which is hereby incorporated by reference.

BACKGROUND OF THE INVENTION

Various systems may be utilized to separate media from a support surface once the media has been interacted upon. Such media ejection systems may be complex, space consuming and unreliable.

DETAILED DESCRIPTION OF THE EXAMPLE EMBODIMENTS

Figure 1:
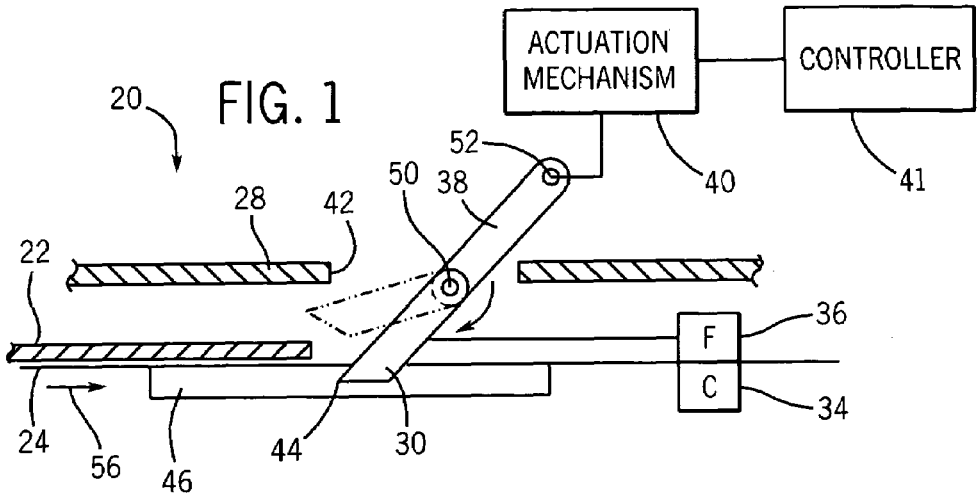
FIG. 1 is a schematic illustration of one example of a media ejection system illustrating the movement of a claw between an ejecting position and a non-ejecting position (shown in phantom) according to one example embodiment.
Figure 2:
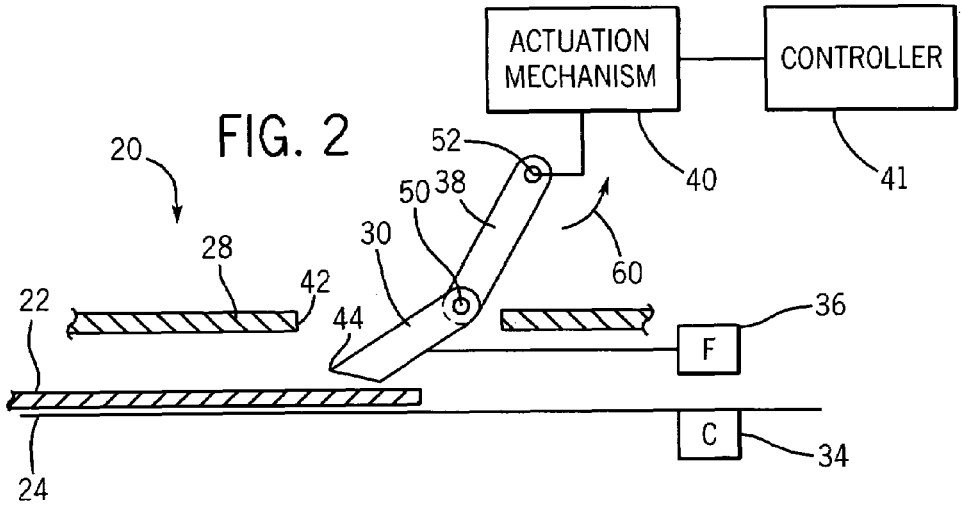
FIG. 2 is a schematic illustration of the media ejection system of FIG. 1 illustrating a cam follower disengaged from a cam according to an example embodiment.
Figure 3:
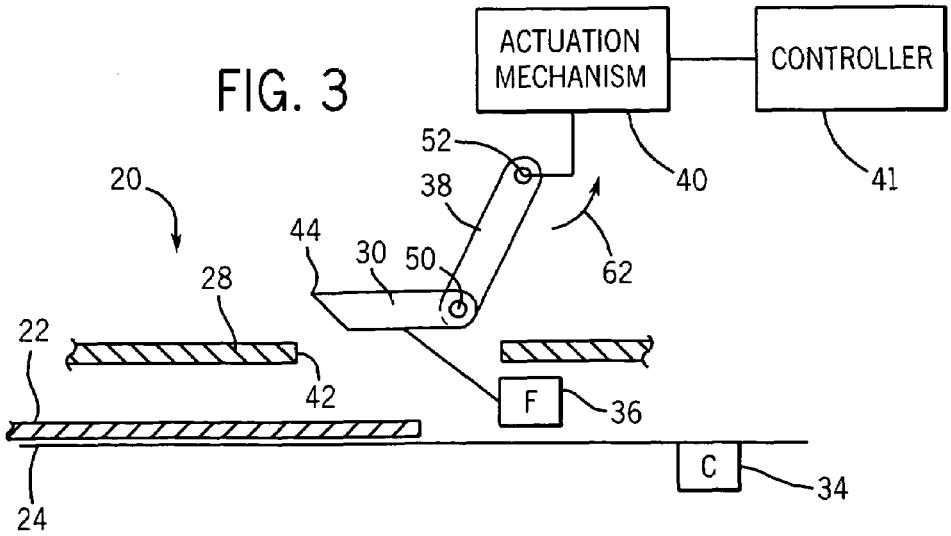
FIG. 3 is a schematic illustration of the media ejection system of FIG. 1 illustrating the claw in a retracted position behind a shield according to an example embodiment.

FIGS. 1-3 schematically illustrate one example of media ejection system 20. System 20 is configured to separate a medium 22, such as a sheet or piece of cellulose-based material, polymer-based material, metallic-based material or combinations thereof, and medium support surface 24 for ejection of the medium 22 from a media interaction system such as a printer, scanner, or other device configured to interact or modify the medium. As shown by FIGS. 1-3, media ejection system 20 generally includes shield 28, claw 30, cam 34, cam follower 36, arm 38, actuation mechanism 40 and controller 41. Shield 28 may comprise a structure extending opposite to medium support surface 24 configured to inhibit the physical contact of a person with claw 30 when claw 30 is in the position shown in FIG. 3. In one embodiment, shield 28 includes opening 42 through which claw 30 or a supporting structure coupled to claw 30 extends when claw 30 is in one of the positions shown in FIG. 1 or 2. As shown in FIG. 3, opening 42 facilitates retraction of claw 30 to a retracted position behind shield 28. In the retracted or shielded position shown in FIG. 3, claw 30 is substantially out of the way, facilitating media jam clearance or other tasks.

Claw 30 may comprise a structure configured to engage and lift media 22 away from medium support surface 24. In the particular embodiment illustrated, claw 30 has a tip 44 configured to extend below a medium 22 to facilitate separation of medium 22 from medium support surface 24. In the particular example illustrated, claw 30 is configured such that tip 44 extends into a channel, divot, depression or groove 46 that is configured to extend below medium 22 to enhance the separation of medium 22 from surface 24. In other embodiments, surface 24 may omit groove 46.

As further shown by FIG. 1, claw 30 is configured to pivot about axis 50 between a media engaging ejecting position (shown in solid lines) in which tip 44 is positioned so as to extend beneath medium 22 and a raised non-ejecting position (shown in phantom) in which tip 44 is sufficiently raised above surface 24 by a distance such that medium 22 may pass beneath claw 30 without being engaged.

Cam 34 may comprise a surface associated with medium support surface 24 that is configured to contact and guide movement of cam follower 36 to control pivoting of claw 30 about axis 50 between the engaging and non-ejecting positions shown in FIG. 1. In one particular embodiment, cam 34 is coupled to medium support surface 24 so as to move with medium support surface 24 as medium support surface 24 moves medium 22. In one particular embodiment, media support surface 24 may be provided by a drum, wherein cam 34 is formed along a surface of the drum or is coupled to an axial end of the drum so as to rotate with the drum. Because cam 34 moves with the movement of medium support surface 24, cam 34 accurately and reliably controls timing of claw actuation between the ejecting and non-ejecting positions without undue complexity.

Cam follower 36 may comprise a structure operably coupled to claw 30 and configured to contact or otherwise engage cam 34 at one or more predetermined points along medium surface 24, wherein such contact results in claw 30 pivoting about axis 50 from the non-ejecting position to the ejecting position. In other embodiments, cam 34 and cam follower 36 may alternatively be configured such that engagement of cam follower 36 with cam 34 causes claw 30 to pivot about axis 50 from the ejecting position to the non-ejecting position. In one particular embodiment, cam follower 36 may include a roller. In other embodiments, cam follower 36 may comprise other surfaces or structures.

Arm 38 may comprise an elongated structure having a first portion pivotally coupled to claw 30 for pivotal movement about axis 50 and a second portion configured to pivot about axis 52. As shown by FIGS. 2 and 3, pivoting of arm 38 about axis 52 results in claw 30 also being rotated about axis 52. In one particular embodiment, axis 50 of claw 30 may also rotate about axis 52 in response to rotation of arm 38 about axis 52. Arm 38 is configured such that pivotal movement of arm 38 about axis 52 moves claw 30 to the withdrawn position in which cam follower 36 is also spaced from cam 34 such that cam 34 may pass beneath cam follower 36 without engaging cam follower 36 and without causing pivotal movement of claw 30 about axis 50. As a result, medium support surface 24 may transport medium 22 past claw 30 without claw 30 being actuated to the ejecting position and without interference from claw 30. When cam follower 36 is spaced from cam 34, medium 22 may be interacted upon multiple times before being separated from medium support surface 24. For example, in particular embodiments, medium 22 may be moved past claw 30 multiple times for multi-pass printing.

As shown by FIG. 3, further pivoting of arm 38 about axis 52 causes claw 30 to be further moved to a retracted position in which tip 44 of claw 30 is spaced further from medium support surface 24. In one particular embodiment, when claw 30 is in the retracted position, tip 44 is retracted to a position so as to inhibit the physical contact with tip 44. In one particular embodiment, in the retracted position, tip 44 of claw 30 is retracted within opening 42 of shield 28. In the particular embodiment illustrated, tip 44 is retracted behind shield 28 in the retracted position. Because physical contact of a person with tip 44 is inhibited while tip 44 is in the retracted position, jams may be more easily cleared.

Actuation mechanism 40 may comprise a mechanism operably coupled to arm 38 and configured to pivot arm 38 about axis 52. In one particular embodiment, actuation mechanism 40 is configured to pivot arm 38 in either direction about axis 52. In one embodiment, actuation mechanism 40 may include a source of torque, such as a rotary actuator, operably coupled to arm 38 by one or more motion transmitting structures such as gear trains, belt and pulley arrangements, chain and sprocket arrangements, links and the like.

Controller 41 may comprise a processing unit configured to generate control signals directing operation of actuation mechanism 40. For purposes of this disclosure, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 41 is not limited to any specific combination of hardware circuitry and software, nor to any particular source for the instructions executed by the processing unit.

In operation, controller 41 generates control signals directing actuation mechanism 40 to appropriately position claw 30 and cam follower 36 relative to medium support surface 24 based at least in part upon a status of interaction with medium 22, such as the status of printing upon medium 22. As shown in FIGS. 1-3, controller 41 generates control signals which cause actuation mechanism 40 to move claw 30 between an ejecting position (shown in FIG. 1), a withdrawn position (shown in FIG. 2) and a retracted position (shown in FIG. 3). FIG. 1 illustrates system 20 in an ejection state or mode. In the ejection mode, arm 38 is appropriately pivoted about axis 52 by actuation mechanism 40 such that cam follower 36, coupled to claw 30, is in engagement with cam 34. Movement of medium support surface 24 in the direction indicated by arrow 56 results in cam 34 interacting with follower 36 to position tip 44 of claw 30 within groove 46, facilitating the engagement of tip 44 of claw 30 with an underside of medium 22 to lift and separate medium 22 from support surface 24. As indicated in phantom, appropriate engagement of cam 34 with cam follower 36 also results in claw 30 being pivoted about axis 50 to a non-ejecting position.

FIG. 2 illustrates system 20 in a ready mode. In the ready cam disengaged mode, controller 41 generates control signals to direct actuation mechanism 40 to pivot arm 38 about axis 52 in the direction indicated by arrow 60. As a result, claw 30 is raised above medium transport surface 24 and cam follower 36 is elevated or spaced from cam 34. As a result, all portions of cam 34 may pass cam follower 36 without claw 30 being lowered to position tip 44 in groove 46. Thus, medium 22 may be transported by surface 24 past claw 30 multiple times such as when multi-pass printing is desired.

FIG. 3 illustrates system 20 in a shielded mode. In the shielded mode, controller 41 generates control signals directing actuation mechanism 40 to pivot arm 38 further in the direction indicated by arrow 62 about axis 52. As shown in FIG. 3, this results in claw 30 being moved even further away from medium transport surface 24 so as to position tip 44 within opening 42 of shield 28 so as to inhibit physical contact with tip 44. Because physical contact of a person with tip 44 is inhibited while tip 44 is in the retracted position, jams may be more easily cleared.

Figure 4:
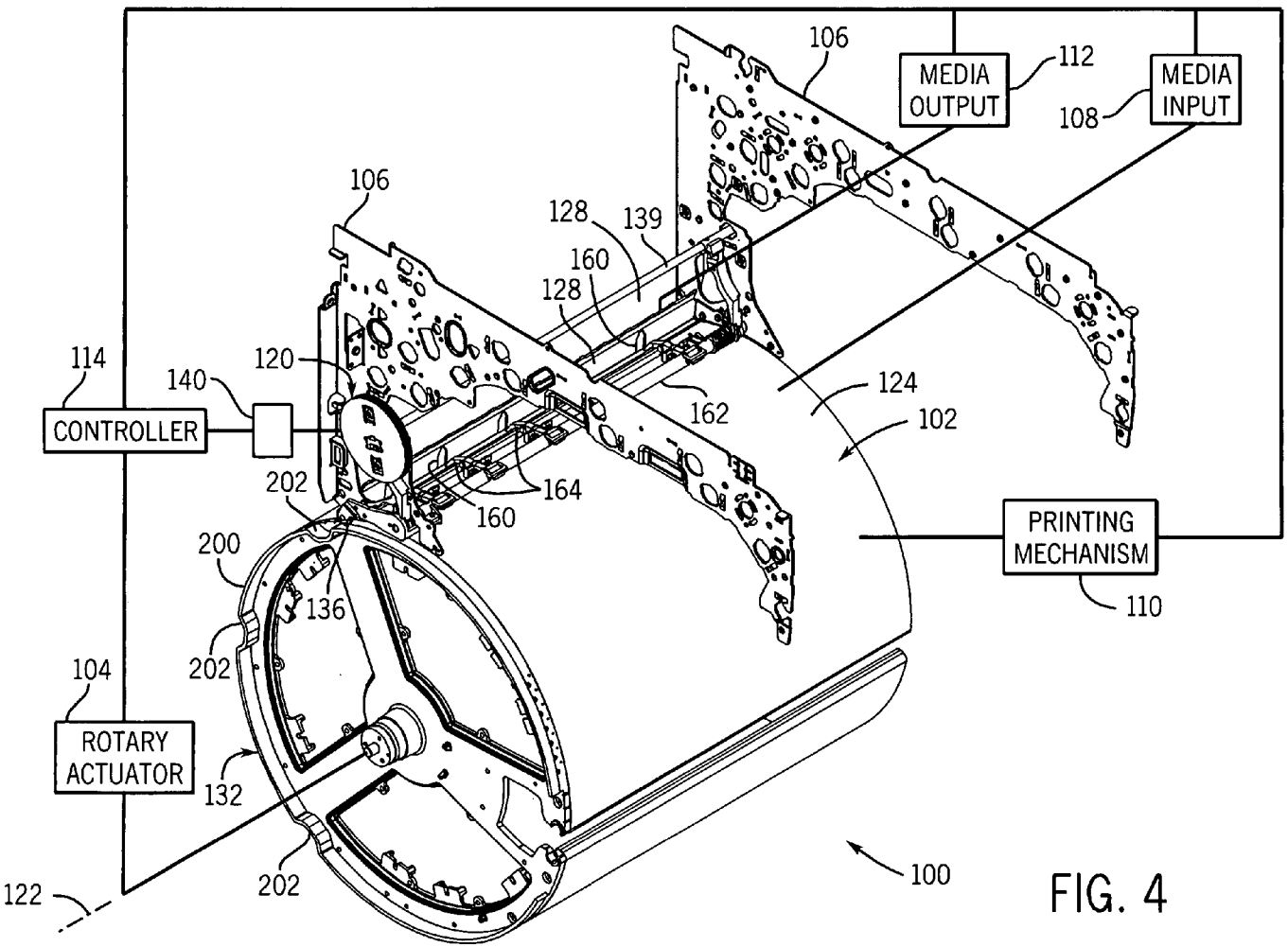
FIG. 4 is a top perspective view of one example of a printing system including one example of the media ejection system of FIG. 1 according to an example embodiment.

FIG. 4 illustrates printing system 100 which includes media ejection system 120, one example embodiment of media ejection system 20 shown and described with respect to FIGS. 1-3. In addition to media ejection system 120, printing system 100 also includes media transport drum 102, rotary actuator 104, frame 106, media input 108, printing mechanism 110, media output 112 and controller 114. Media transport drum 102 may comprise a large generally cylindrical member configured to be rotatably driven about axis 122 and including medium support surface 124. Medium support surface 124 may comprise a generally circumferential surface upon which one or more sheets of medium, such as paper and the like, may be held during printing and/or other interaction. In one particular embodiment, medium support surface 124 includes elongated circumferential grooves or depressions, such as grooves 46 shown in FIG. 1, to facilitate separation of sheets from surface 124. In particular embodiments, medium support surface 124 may additionally include perforations or other openings through which a vacuum may be applied to selectively retain one or more sheets against surface 124. In other embodiments, electrostatic charges may be created along surface 124 to retain one or more sheets against surface 124. In the particular embodiment illustrated, support surface 124 is configured to retain at least three 8½×11 sheets of a medium. In other embodiments, surface 124 may be configured to support a fewer or greater number of the same sheets or larger or smaller sheets.

Rotary actuator 104 may comprise a device configured to rotatably drive drum 102 about axis 122 to move the one or more sheets from media input 108 to printing mechanism 110 and ultimately to media ejection system 120 and media output 112. In one embodiment, rotary actuator 104 may comprise an electric motor operably coupled to drum 102 by a transmission or other power train. In other embodiments, rotary actuator 104 may comprise other devices configured to provide torque to rotate drum 102.

Frame 106 may comprise one or more structures proximate to drum 102 that are configured to support the components of printing system 100 relative to drum 102. As shown by FIG. 4, frame 106 supports media ejection system 120 relative to drum 102. In particular embodiments, frame 106 may also be configured to support at least portions of media input 108 and printing mechanism 110 relative to drum 102. Although illustrated as including two parallel plates, frame 106 may have various other sizes and configurations and may support fewer or additional components of printing system 100.

Media input 108 (schematically shown) may comprise a mechanism configured to supply and transfer sheets of media to drum 102 of printing system 100. In one embodiment, media input 108 may include a media storage volume, such as a tray, bin and the like, one or more pick devices (not shown) configured to pick a sheet of media from the storage volume and one or more media transfer mechanisms configured to transfer the media to drum 102. Media input 108 may have a variety of sizes and configurations.

Printing mechanism 110 (schematically shown) may comprise a mechanism or device configured to print or otherwise form an image upon sheets of media held by drum 102. In one embodiment, printing mechanism 110 may be configured to eject fluid ink onto sheets of media held by drum 102. In one embodiment, printing mechanism 110 may include one or more printheads carried by a carriage that are configured to be scanned across sheets of media held by drum 102 in directions generally along axis 122. In other embodiments, printing mechanism 110 may include printheads which substantially extend across a width or a dimension of sheets of media held by drum 102 such as with a page-array printer. In still other embodiments, printing mechanism 110 may comprise other printing devices configured to deposit ink, toner or other printing material upon sheets of media held by drum 102 in other fashions.

Media output 112 may comprise a mechanism or device configured to transport sheets of media that have been separated from drum 102 by media ejection system 120 to one or more locations for further interaction with such removed sheets or for output to a user of printing system 100. For example, in one embodiment, media output 112 may be configured to transport such ejection sheets of media to a duplexer and back to media input 108 for two-sided printing. In still another embodiment, media output 112 may be configured to transport such ejected sheets to an output tray or bin for receipt by a user of printing system 100.

Controller 114 may comprise one or more processing units configured to generate control signals directing the operation of rotary actuator 104, media input 108, printing mechanism 110, media output 112 and media ejection system 120. For purposes of this disclosure, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 114 is not limited to any specific combination of hardware circuitry and software, nor to any particular source for the instructions executed by the processing unit.

Figure 11A:
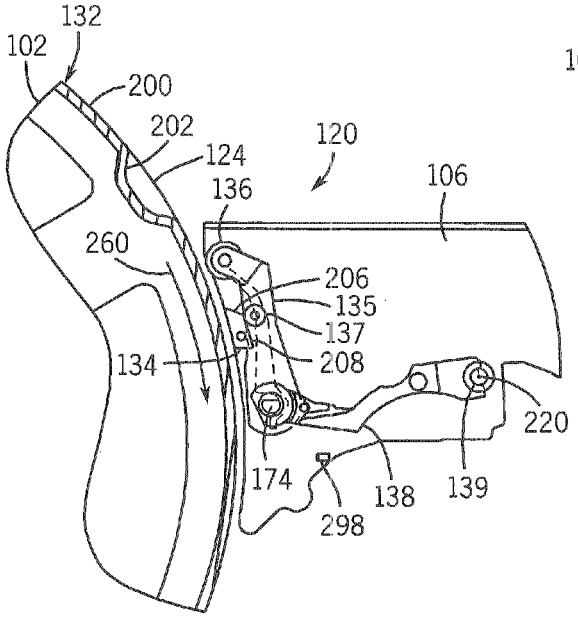
FIG. 11*a* is a sectional view of the media ejection system of FIG. 4 illustrating the cam follower and cam in a withdrawn position according to an example embodiment.
Figure 11B:
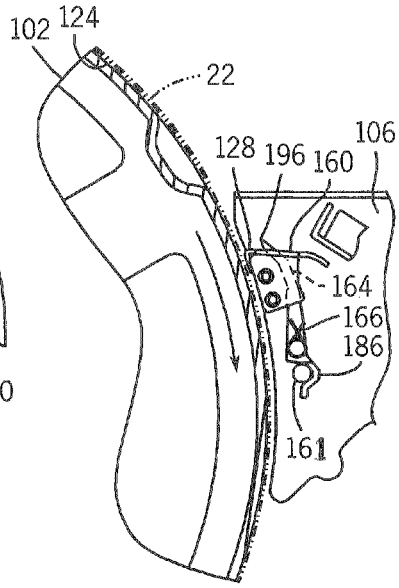
FIG. 11*b* is a sectional view of the media ejection system of FIG. 4 illustrating the claw in a withdrawn position during the ready mode according to an example embodiment.

In operation, controller 114 generates control signals directing rotary actuator 104 to rotatably drive drum 102 about axis 122. Controller 114 further generates control signals directing media input 108 to pick or otherwise supply a sheet of media to drum 102. Drum 102 transfers a sheet to printing mechanism 110. In response to control signals from controller 114, printing mechanism 110 prints or otherwise forms an image upon the sheet. Thereafter, drum 102 transports the printed upon sheet to media ejection system 120. If printing mechanism 110 is to perform an additional printing pass over the sheet of media, controller 114 generates control signals so as to move or maintain media ejection system 120 in a ready cam disengaged mode as shown in FIGS. 11*a* and 11*b* as will be described in greater detail hereafter. In such a cam disengaged mode, media ejection system 120 permits the sheet of media to pass beneath system 120 to printing mechanism 110 once again.

Figure 9A:
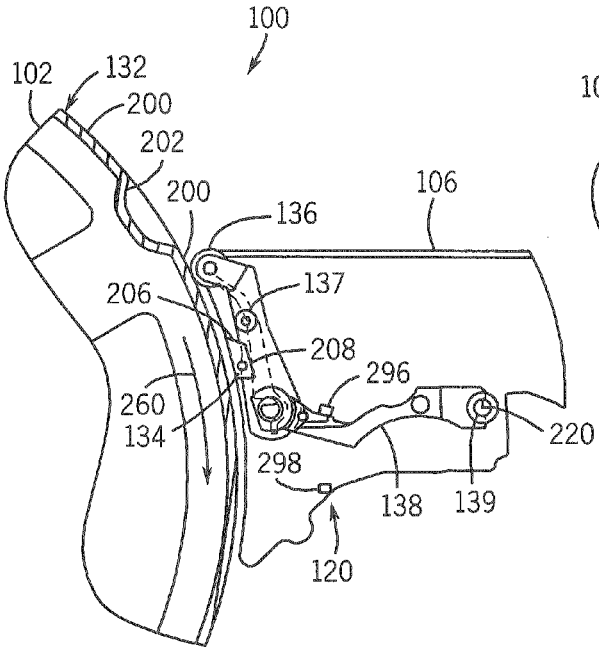
FIG. 9*a* is a sectional view of the media ejection system of FIG. 4 illustrating a cam follower in a non-ejecting position in the ejection mode according to an example embodiment.
Figure 9B:
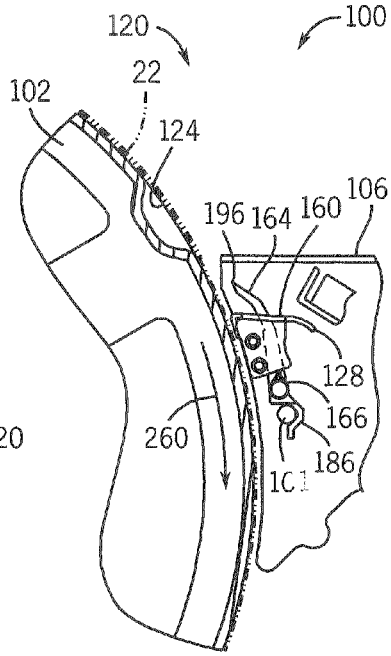
FIG. 9*b* is a sectional view of the media ejection system of FIG. 4 illustrating a claw in a non-ejecting position during the ejection mode according to an example embodiment.
Figure 10A:
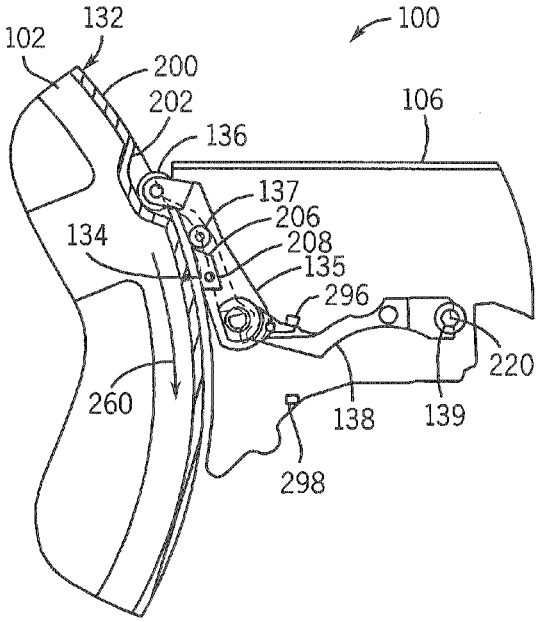
FIG. 10*a* is a sectional view of the media ejection system of FIG. 4 illustrating the cam follower in an ejecting position during the ejection mode according to an example embodiment.
Figure 10B:
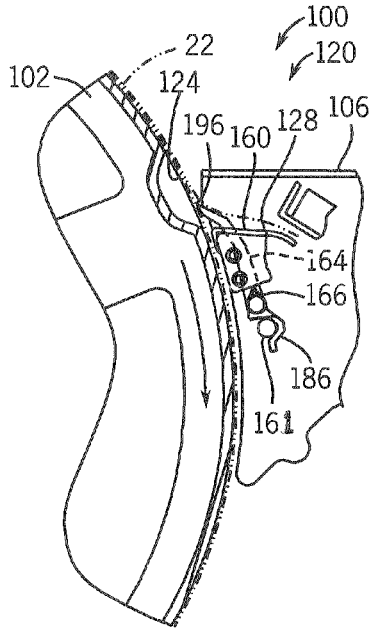
FIG. 10*b* is a sectional view of the media ejection system of FIG. 4 illustrating the claw in the ejecting position during the ejection mode according to an example embodiment.

Alternatively, if the printed upon sheet is ready for separation from drum 102, controller 104 generates control signals directing actuation mechanism 140 to move or actuate media ejection system 120 to the ejection mode shown in FIGS. 9*a*, 9*b*, 10*a* and 10*b*, as will be described in greater detail hereafter, prior to drum 102 moving the printed upon sheet to media ejection system 120. Once the drum 102 sufficiently rotates to position the printed upon sheet proximate to ejection system 120, the printed upon sheet will be separated from drum 102 as shown in FIG. 10*b*. Thereafter, in response to control signals from controller 114, media output 112 will transfer the sheets separated from drum 102 to another location for further printing or manipulation of the printed upon sheet or for receipt by a user printing system 100.

Upon shutdown or idle mode of printing system 100 or in those circumstances in which printing system 100 experiences a media jam or should be repaired or cleaned, controller 114 may additionally generate control signals causing actuation mechanism 140 to actuate media ejection system 120 to a retracted or shielded mode shown in FIGS. 12*a* and 12*b* as will be described in greater detail hereafter.

FIGS. 5-8 illustrate media ejection system 120 of printing system 100 in more detail. System 120 generally includes shield 128 (shown in FIG. 4), claw assembly 130, spring 131, cam 132 (shown in FIG. 4), cam 134, lever 135, cam follower 136, cam follower 137, arms 138, pivot shaft 139, and actuation mechanism 140. Shield 128, shown in FIG. 4, may comprise an elongated structure extending axially across drum 102 and spaced above drum 102 by frame 106. Shield 128 includes multiple apertures 160 along its length through which portions of claw assembly project into engagement with sheets of media when ejection system 120 is in the ejection mode shown in FIGS. 9*a*, 9*b*, 10*a* and 10*b*, or when media ejection system is in the ready or cam disengaged mode shown in FIGS. 11*a* and 11*b*. Apertures 160 further permit portions of claw assembly 130 to be retracted within or behind shield 128 when ejection system 120 is in the shielded mode shown in FIGS. 12*a* and 12*b*. As a result, shield 128 inhibits physical contact of a user with portions of claw assembly 130 while media ejection system 130 is in the shielded mode.

Figure 7:
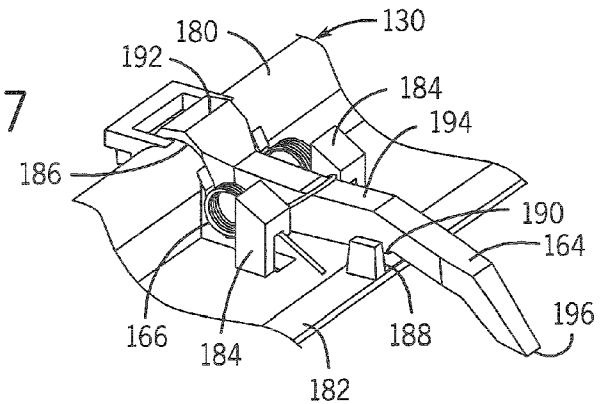
FIG. 7 is a fragmentary enlarged perspective view of a portion of the claw assembly of FIG. 6 according to an example embodiment.
Figure 6:
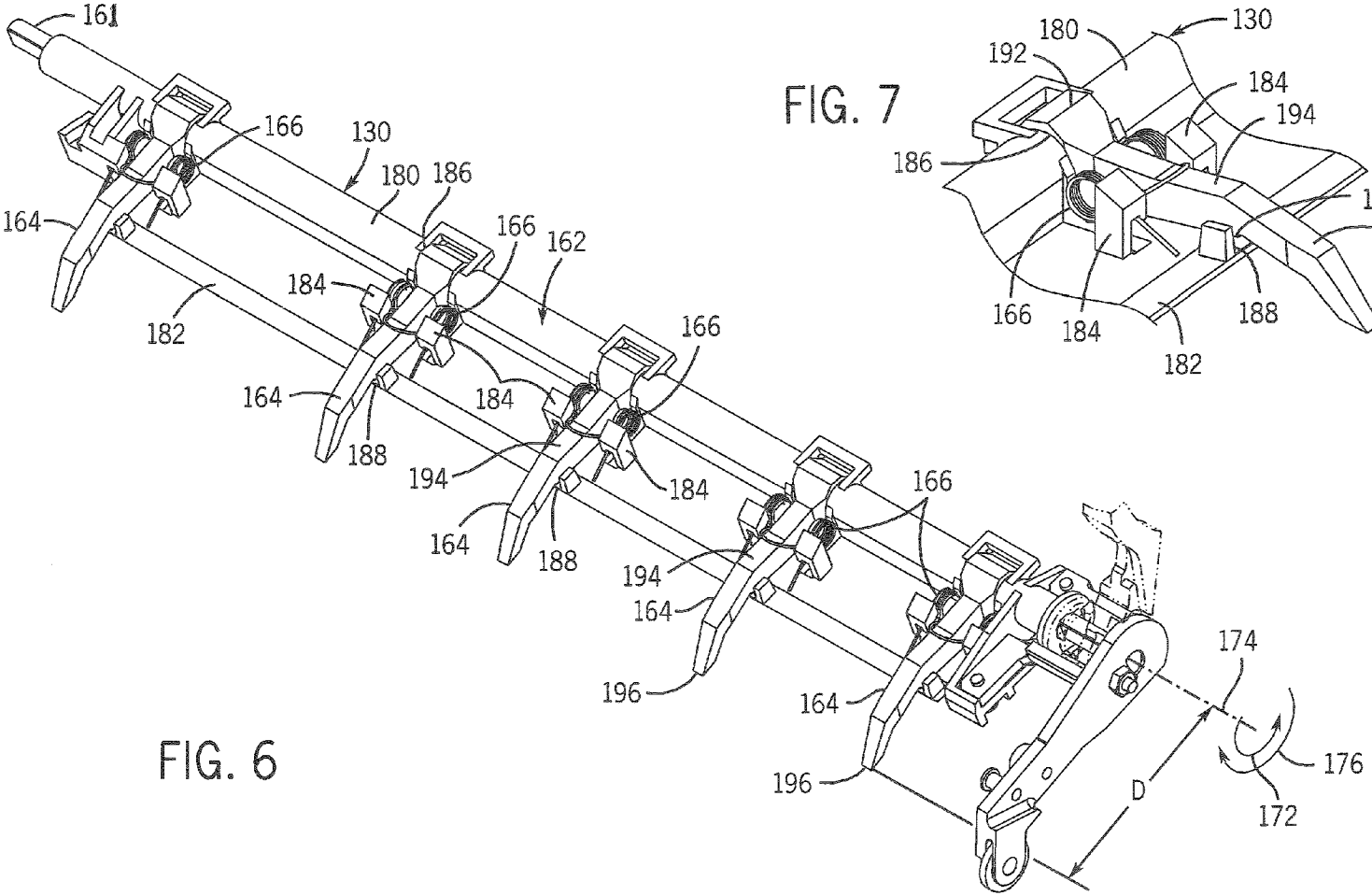
FIG. 6 is an enlarged perspective view of a claw assembly and lever of the media ejection system of FIG. 5 according to an example embodiment.
Figure 8:
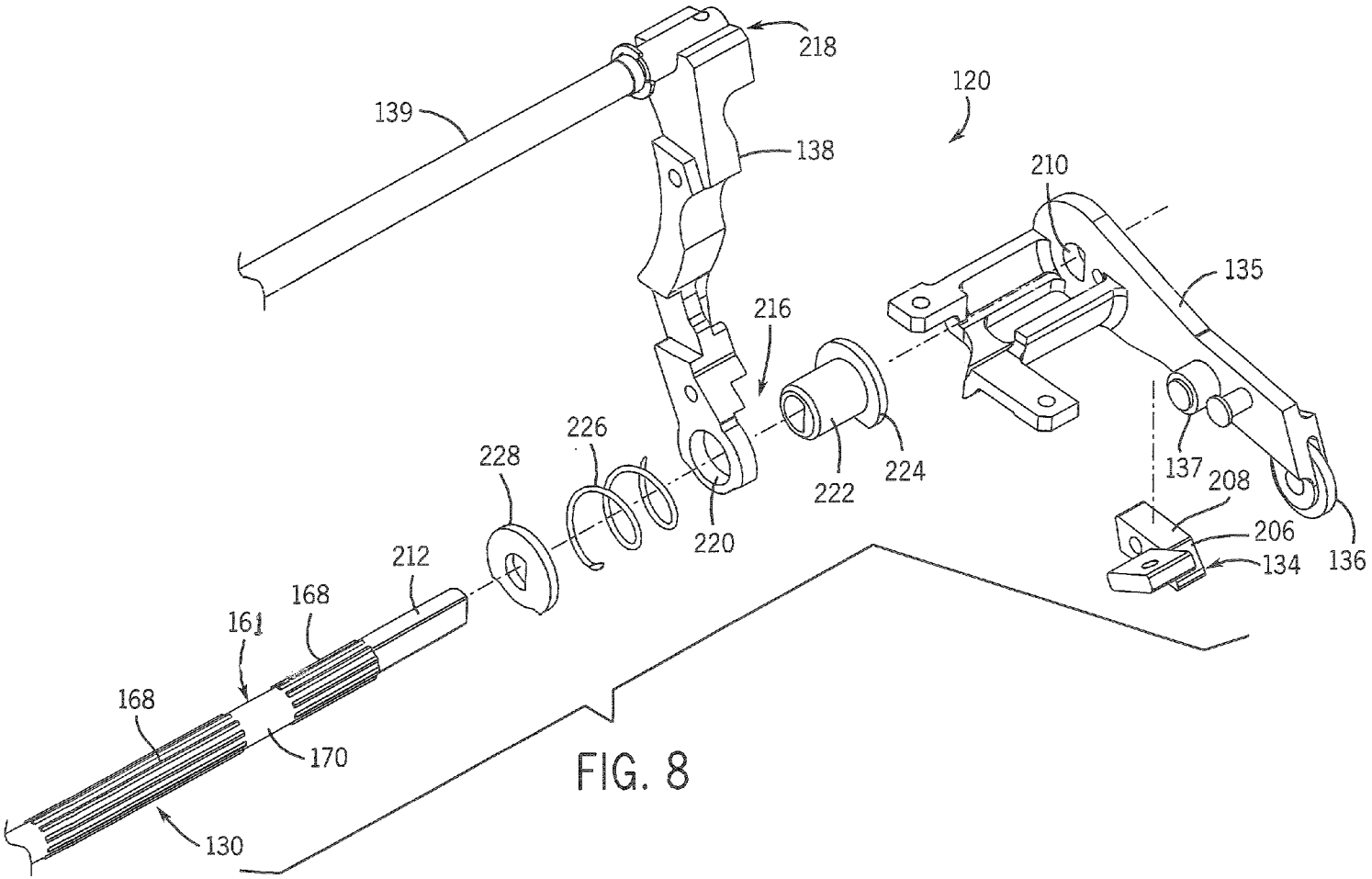
FIG. 8 is a fragmentary exploded perspective view of a portion of the media ejection system of FIG. 5 according to an example embodiment.

Claw assembly 130 may comprise that portion of media ejection system 120 configured to physically contact or engage sheets of media to separate the sheets of media from drum 102 (shown in FIG. 4). FIGS. 6 and 7 illustrate claw assembly 130 in more detail. As shown by FIGS. 6 and 7, claw assembly 130 generally includes support shaft 161, support 162, claws 164 and claw retainers 166. Support shaft 161 may comprise an elongated shaft to which support 162 and claws 164 are mounted. As shown in FIG. 8, in one embodiment, support shaft 161 includes knurled portions 168 and substantially smooth portions 170. Knurled portions 168 engage support 162 such that rotation of shaft 161 also results in rotation of support 162. Smooth portions 170 are configured to be received within and to engage portions of claws 164, enabling claws 164 to rotate about shaft 161 relative to support 162. In other embodiments, support shaft 161 may be coupled to support 162 and claws 164 in other fashions.

Support 162 (sometimes referred to as a holder or paw) may comprise an elongated structure configured to extend into contact with multiple claws 164 so as to enable claws 164 to be uniformly and simultaneously moved in a first direction 172 about axis 174 and so as to uniformly limit and control movement of claws 164 in a direction 176 about axis 174. Support 162 further enables multiple individual claws 164 to be connected to support 162 as a single assembly, further facilitating pre-assembly of claw assembly 130 and efficient connection of claws 164 to support post 160.

As shown by FIGS. 6 and 7, support 162 generally includes collar 180, platform 182 and clips 184. Collar 180 may comprise that portion of support 162 configured to connect support 162 to support shaft 161. In one embodiment, collar 180 is molded about shaft 161. In other embodiments, connection of collar 180 to shaft 161 may be achieved in other fashions. Collar 180 includes openings 186 through which claws 164 may partially encircle smooth portions 170 (shown in FIG. 8) of support shaft 160. In other embodiments, openings 186 may be omitted where support 162 itself includes a shaft or other bearing structure configured to facilitate rotational movement of claws 164 about axis 174.

Platform 182 may comprise an elongated blade, bar or other structure extending from collar 180 generally below claws 164. Platform 182 supports clips 184 and includes datum surfaces 188. Datum surfaces 188 engage opposite datum pads or surfaces 190 of an associated claw 164 to control the angular positioning of claw 164 about axis 174. Because a single support 162 provides such datums 188 for each of claws 164, claws 164 may be more reliably located at the same position with respect to axis 174.

Clips 184 may comprise structures extending from platform 182 that are configured to retain claw retainers 166 in place with respect to claws 164 and with respect to support 162. In the particular example shown, clips 184 extend on opposite sides of each claw 164 and engage opposite ends of a claw retainer 166. In other embodiments, clips 184 may have other configurations and may have other locations depending upon the configuration of claws 164 and the configuration of claw retainers 166. In some embodiments, clips 184 may be omitted.

Claws 164 may comprise elongated pins, fingers or other structures configured to extend towards a surface of drum 102 (shown in FIG. 4) so as to engage and separate a sheet of media from drum 102. In the particular embodiment illustrated, each claw 164 is integrally formed as a single unitary body from a high strength-to-weight ratio material such as magnesium. The reduced weight of each claw 164 reduces bouncing of claw 164 on drum 102. In the particular example illustrated, each claw 164 is further coated with a material such as a ceramic coating to reduce wear. In other embodiments, each claw 164 may be formed from other materials, may be formed from multiple portions welded, bonded or otherwise fastened to one another and may include other wear coatings or may omit such wear coatings.

As shown by FIG. 7, each claw 164 generally includes a knuckle portion 192, an intermediate portion 194 including datum pad 190, and a tip 196. Knuckle 192 may comprise an elongated downwardly extending V- or C-shaped portion configured to partially extend about smooth portion 170 of shaft 161 (shown in FIG. 8). As a result, claws 164 may be positioned about support shaft 161 after support 162 has been connected to support shaft 161. In other embodiments, knuckle 192 may have other configurations that pivotally connect claw 164 to support shaft 161 or support 162.

Intermediate portion 194 extends between knuckle 192 and tip 196 along a top portion of platform 182 of support 162. Intermediate portion 194 has an underside including datum pad 190. As noted above, datum pad 190 is configured to contact datum surface 188 on platform 182 to control the positioning of claw 164 and its tip 196 with respect to drum 102 and any media being separated. In the particular example illustrated in which tip 196 is spaced from axis 174 (shown in FIG. 6) by a linear distance D, contact pad 190 is spaced from axis 174 by a distance of at least 0.1D and nominally at least about 0.5D. In the particular embodiment illustrated, datum pad 190 is spaced from axis 174 by a distance of about 25.4 mm. Because datum pad 190 is spaced from axis 174 by a distance of at least 0.1D, angular misalignment of tips 196 with respect to one another about axis 174 may be reduced, enabling more precise positioning of claws 164.

Tip 196 extends at an end of claw 164 and is configured to project between sheets of media and drum 102. In the particular example illustrated, tip 196 is pointed to enhance insertion of tip 196 between sheets of media and drum 102 (shown in FIG. 4). In other embodiments, tip 196 may have other shapes.

Spring retainers 166 may comprise one or more structures configured to resiliently bias datum pads 190 against the datum surfaces 188. In the particular embodiment illustrated, spring retainers 166 are further configured to retain their respective claws 164 relative to support shaft 161 and support 162. In other embodiments, claws 164 may be retained relative to support shaft 161 by claws 164 snapping about support shaft 161 or other retention structures. In the particular example illustrated, spring retainers 166 may comprise torsion springs mounted to support 162 by clips 166 and extending over intermediate portion 194 of each claw 164. In the particular example illustrated, each retainer 166 further retains claw 164 to support 162 as an assembly. Although claw assembly 130 is illustrated as including an individual retainer 166 for each claw 164, in other embodiments, a retainer 166 may resiliently retain more than one claw 164 relative to support 162. Although retainers 166 are illustrated as structures distinct from support 162, in other embodiments, retainers 166 may be integrally formed as part of support 162.

Figure 5:
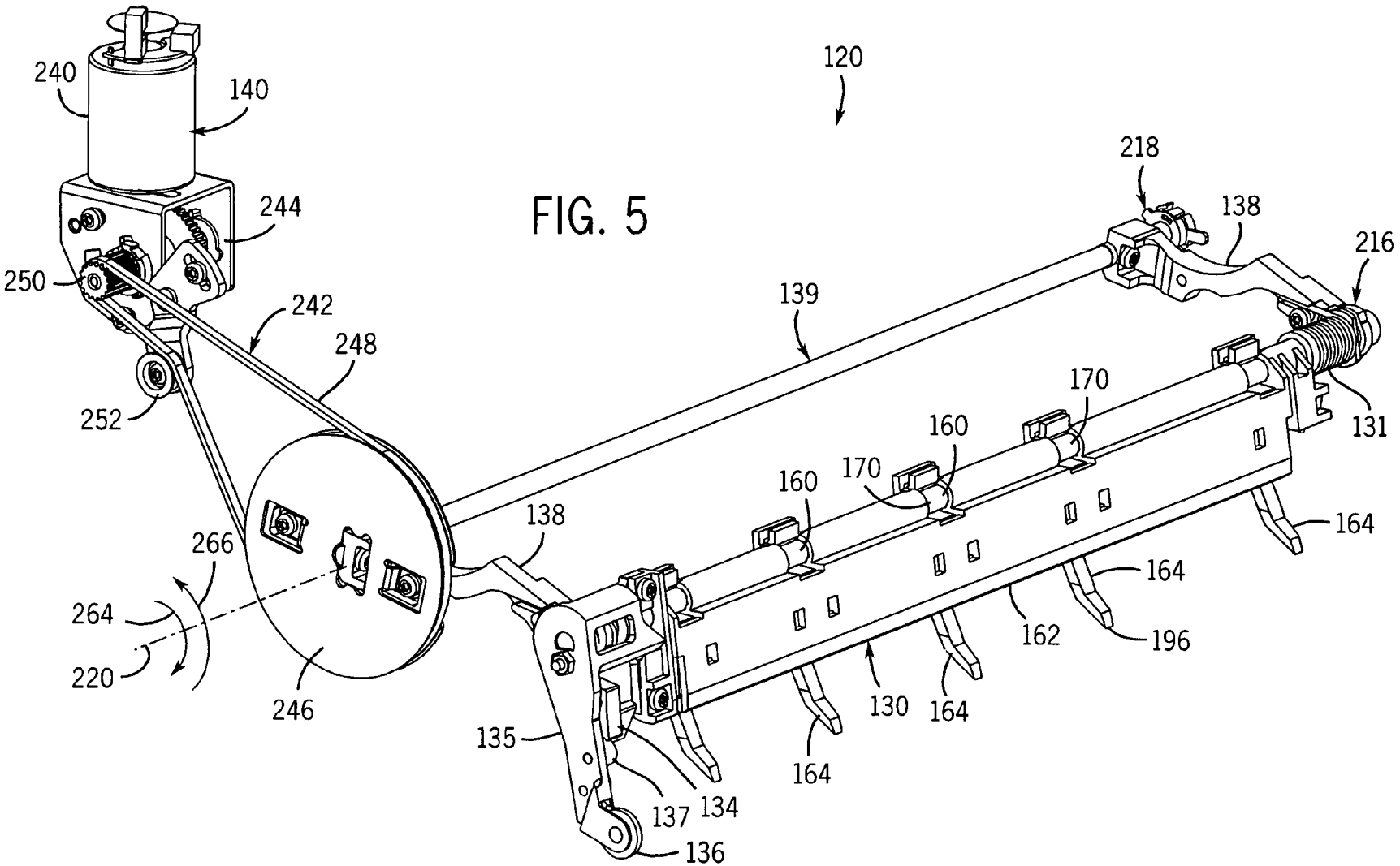
FIG. 5 is an enlarged view of the media ejection system of FIG. 4 according to an example embodiment.

As shown by FIG. 5, spring 131 may comprise a structure configured to resiliently bias support shaft 161, support 162 and claws 164 about axis 174 in the direction indicated by arrow 176 in FIG. 6. Such bias force urges claw assembly 130 about axis 174 until either cam follower 136 is against cam 132 or until cam follower 137 is against cam 134. In the particular example illustrated, spring 131 may comprise a torsion spring having one end coupled to arm 138 and having another end connected to support 162. In other embodiments, spring 131 may comprise other spring mechanisms and may be at other locations.

Cam 132 (shown in FIG. 4) may comprise a surface configured to interact with cam follower 136 so as to control the positioning of lever 135 and claws 164 of claw assembly 130 in response to rotation of drum 102. In the particular example illustrated, cam 132 may comprise an annular or circumferential member secured to an axial end of drum 102. Cam 132 includes surface portions 200 and 202. Surface portions 200 may comprise surfaces configured such that when in engagement with cam follower 136, claw assembly 130 is positioned with tips 196 of claws 164 elevated above medium support surface 124 of drum 102 in a non-ejecting position. The locations of portions 202 are positioned to correspond with pre-determined locations of leading edges of media.

Surface portions 202 may comprise surfaces configured such that when in engagement with cam follower 136, claw assembly 130 is moved towards surface 124 of drum 102 such that tips 196 of claws 164 extend between surface 124 of drum 102 and an upcoming sheet of media carried by drum 102 in an ejecting position. In the particular example illustrated, surface portions 202 may comprise concavities or depressions such that cam follower 136 and lever 135 dip into surface portions 202 to lower claws 164 into a position for separating a sheet of media from drum 102. In the particular example illustrated, cam 132 includes three spaced surface portions 202, permitting drum 102 to simultaneously support three sheets of media. In other embodiments, cam 132 may include a greater or fewer number of such surface portions 202. In still other embodiments, cam 132 may include surface portions 202 having other configurations.

Cam 134 may comprise a structure configured to interact with cam follower 137 to selectively reposition lever 135 and cam follower 136 with respect to drum 102. In the particular example illustrated, cam 134 is supported by frame 106 (shown in FIG. 4) proximate to cam follower 137. As shown by FIG. 8, cam 134 includes sloped or inclined surfaces 206 and 208. Surface 206 is configured to engage cam follower 137 so as to move cam follower 136 out of engagement with cam 132. In particular, surface 206 engages cam follower 137 to move cam follower 136 from an ejecting position (shown in FIGS. 9*a* and 9*b*) to a withdrawn position (shown in FIGS. 11*a* and 11*b*). Surface 208 is configured to engage cam follower 137 to move lever 135 and cam follower 136 to the retracted position (shown in FIGS. 12*a* and 12*b*). Although surfaces 206 and 208 are illustrated as being generally linear, surfaces 206 and 208 may have other shapes and relative positions.

Lever 135 may comprise an elongated rigid structure fixedly coupled to support shaft 161 so as to rotate with support shaft 160. As shown by FIG. 8, in the particular example illustrated, lever 135 has a generally non-circular opening 210 configured to receive a non-circular end portion 212 of support shaft 161. In other embodiments, lever 135 may be coupled to support shaft 161 in other manners so as to rotate with rotation of support shaft 161. Lever 135 supports cam followers 136 and 137.

Cam follower 137 may comprise a structure configured to bear against surfaces 206 and 208 of cam 134 during movement of lever 135 and cam follower 136 between the ejection, cam disengaged and shielded modes shown in FIGS. 9A, 9B, 10*a* and 10*b*, FIGS. 11*a* and 11*b*, and FIGS. 12A and 12B, respectively. In the particular example illustrated, cam follower 137 may comprise a wheel or roller rotatably supported at midpoint of lever 135 generally opposite to cam 134. In other embodiments, cam follower 137 may comprise other movable or immovable structures mounted or otherwise coupled to lever 135 at an appropriate location.

As shown by FIGS. 5 and 8, arms 138 may comprise elongated members having a first portion 216 pivotally connected to claw assembly 130 and lever 135 and a second portion 218 fixedly coupled to pivot shaft 139. As shown by FIG. 8, portion 216 of each of arms 138 has a generally cylindrical bore 220 which is rotatably positioned about a cylindrical bushing 222 through which end 212 of support shaft 161 extends. As further shown by FIG. 8, portion 216 of arm 138 is captured on bushing 222 by head portion 224 of bushing 222 and by spring 226 and washer 228. In other embodiments, portion 216 of arm 138 may be rotatably or pivotally connected to support shaft 161 and/or lever 135 in other fashions. Although ejection system 120 is illustrated as including two opposite arms 138, in other embodiments, ejection system 120 may include fewer or greater of such arms coupled to claw assembly 130 and fever 135.

Pivot shaft 139 (shown in FIG. 5) may comprise an elongated shaft extending between and fixedly coupled to both of arms 138. Pivot shaft 139 may comprise a biasing torsional interconnection between arms 138 such that arms 138 may pivot about pivot axis 220 in substantial unison to maintain claw assembly 130 and surface 124 of drum 102 substantially parallel. The biasing interconnection allows both arms 138 to engage stops 296 as shown in FIGS. 9*a* and 10*a*. In other embodiments, other structures may be utilized to interconnect arms 138.

Actuation mechanism 140 may comprise a mechanism configured to selectively pivot shaft 139 about axis 220 so as to also pivot arms 138 about axis 220. Pivoting of arms 138 about axis 220 results in cam follower 137 being moved relative to cam 134 to move lever 135 and cam follower 136 relative to surface 124 of drum 102 (shown in FIG. 4) to actuate system 120 between the ejection, cam disengaged and shielded modes. Actuation mechanism 140 generally includes rotary actuator 240 and pivot drive 242. Rotary actuator 240 may comprise a source of torque. In one embodiment, rotary actuator 240 may comprise an electric motor such as a DC motor with an encoder. In yet another embodiment, motor 240 may comprise a stepper motor. In still other embodiments, other motors may be utilized. In some embodiments, actuation mechanism 140 may additionally include one or more sensors configured to sense the angular positioning of structures corresponding to the angular position of arms 138 or pivot shaft 139 to facilitate control of torque supplied by rotary actuator 240.

Pivot drive 242 may comprise one or more structures configured to transmit torque from rotary actuator 240 to pivot shaft 139 with an appropriate amount of torque and an appropriate amount of speed. In the particular example illustrated, pivot drive 242 includes a first gear train portion 244, a toothed pulley 246 and an intermediate belt 248. Gear train portion 244 receives initial torque from rotary actuator 240 and terminates at toothed pinion 250 which is in engagement with belt 248. Belt 248 extends from toothed pinion 250 and encircles toothed pulley 246. Belt 248 is maintained in tension by belt tensioner 252 and transmits torque to pulley 246 to rotate pivot shaft 139 in either direction about axis 220. In other embodiments, pivot drive 242 may comprise other transmission or drive train assemblies. For example, in one embodiment, pivot drive 242 may alternatively include chain and sprocket assemblies or may utilize gear trains extending from rotary actuator 240 to pivot shaft 139. In other embodiments, pivot drive 242 may be operably coupled to a rotary actuator that also supplies torque to other components of printing system 100 (shown in FIG. 4).

FIGS. 9*a*-12*b* illustrate actuation of media ejection system 120 between various modes of operation. FIGS. 9*a*-10*b* illustrate media ejection system 120 in a media ejection mode in which cam follower 136 rides upon cam 132. To move cam follower 136 into engagement with cam 132, actuation mechanism 140 (shown in FIG. 5) pivots shaft 139 downward in the direction indicated by arrow 264 about axis 220 as seen in FIG. 5 until arm 138 contacts or abuts datum stop 296. Datum stop 296 may comprise a structure that is fixed or stationary with respect to drum 102 and with respect to arm 138. In one embodiment, datum stop 296 may comprise a projection extending from frame 106 (shown in FIG. 4). As a result, cam follower 137 is rolled along surface 208 and down surface 206 of cam 134 until cam follower 136 is in engagement with cam 132 as shown in FIG. 9*a*. As seen in FIG. 9*b*, this also results in claws 164 being lowered through openings 160 of shield 128 towards media support surface 124 of drum 102.

During rotation of drum 102 in the direction indicated by arrow 260, cam follower 136 rolls along surface portion 200 until engaging surface portion 202 shown in FIG. 10*a*. As shown in FIG. 10*a*, surface portion 202 causes cam roller 136 to clip into the depression of surface portion 202. As shown in FIG. 10*b*, this results in claw assembly 130 and claws 164 also being lowered to position tips 196 below a bottom of the sheet of media 22 to be separated from drum 102. In one particular embodiment, surface 124 may include channels, grooves, concavities and the like, into which tips 196 may project further below a bottom of the sheet 22 to be separated from drum 102. Once the sheet has been separated from drum 102, continued rotation of drum 102 results in cam follower 136 rolling out of the depression of surface portion 202 and back up onto a succeeding surface portion 200 which results in claws 164 once again rising above surface 124. In particular embodiments, such rising may occur while claws 164 are in engagement with a bottom of a sheet to further facilitate separation of the sheet from surface 124 of drum 102.

FIGS. 11*a* and 11*b* illustrate ejection system 120 in a ready or cam disengaged mode. To actuate media ejection system 120 from the ejection mode to the ready mode, actuation mechanism 140 rotates pivot shaft 139 about axis 220 in the direction indicated by arrow 266. As a result, cam follower 137 is moved into engagement with surface 206 and is rolled up to surface 206 onto surface 208 to the position shown in FIG. 11*a*. Consequently, cam follower 136 is withdrawn from cam 132. In the ready mode, cam follower 137 rests upon surface 208 of cam 134 proximate to surface 206. As a result, lever 135 is raised to support cam follower 136 out of engagement with cam 132 of drum 102. As a result, drum 102 may continue to be rotated in the direction indicated by arrow 260 so as to move surface portion 202 of cam 200 past cam follower 136 without surface portion 202 engaging cam follower 136, without claw 164 (shown in FIG. 11*b*) dipping below sheet 22 of media (shown in FIG. 11*b*), allowing media sheet 22 to move past media ejection system 120. Because media sheet 22 may be moved past media ejection system 120, drum 102 may position sheet 22 opposite printing mechanism 110 (shown in FIG. 4) once again for multi-pass printing or at other stations.

Figure 12A:
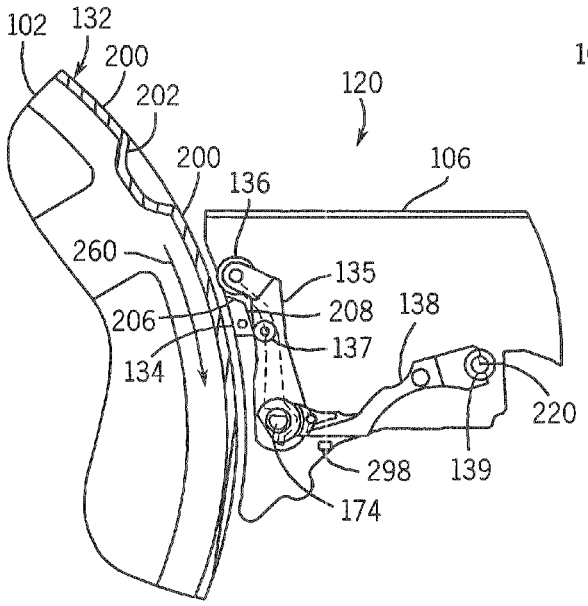
FIG. 12*a* is a sectional view of the media ejection system of FIG. 4 illustrating the cam follower and cam in a retracted position during the shielded mode according to an example embodiment.
Figure 12B:
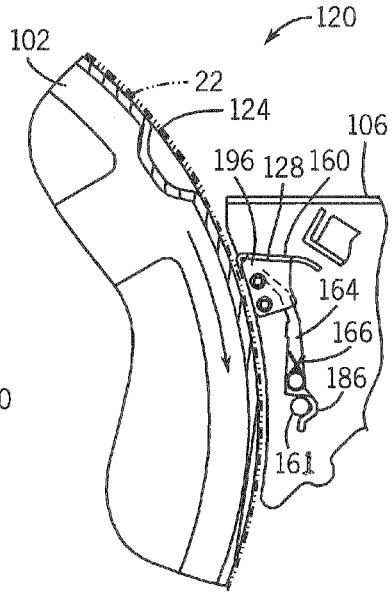
FIG. 12*b* is a sectional view of the media ejection system of FIG. 4 illustrating the claw in a retracted position during the shielded mode according to an example embodiment.

FIGS. 12*a* and 12*b* illustrate media ejection system 120 in a shielded mode. As shown in FIG. 12*a*, in the shielded mode, cam follower 137 is positioned at a rear of surface 208 of cam 134. Actuation of media ejection system 120 from the ready mode shown in FIG. 11*a* to the shielded mode shown in FIG. 12*a* is achieved by actuation mechanism 140 (shown in FIG. 5) further rotating pivot shaft 139 about axis 220 in the direction indicated by arrow 266 until arm 138 contacts or abuts datum stop 298. Datum stop 298, like datum stop 296, may comprise a projection or other surface that is fixed or stationary with respect to drum 102 and with respect arm 138. In one embodiment, datum stop 298 may comprise a projection extending from frame 106. As a result, cam follower 137 rolls from the withdrawn position shown in FIG. 11*a* along surface 208 to the retracted position shown in FIG. 12*a*. As shown in FIG. 12*b*, this results in claws 136 being retracted through openings 160 behind shield 128. In this position, shield 128 inhibits physical contact with the potentially sharp tips 196 of claws 164 to facilitate clearing of media jams, repair or maintenance activities.

As discussed above, media ejection system 120 is actuated between the ejection mode (shown in FIGS. 9*a*, 9*b*, 10*a* and 10*b*), the ready mode (shown in FIGS. 11*a* and 11*b*) and the retracted or shielded mode (shown in FIGS. 12*a* and 12*b*) based upon torque supplied by rotary actuator 240 (shown in FIG. 5). The duration for which rotary actuator 240 supplies torque, the amount of torque and the speed is in part based upon data obtained during a start-up calibration routine and continuous operation calibration routines. Upon start-up or initialization, which may occur after power cycling, or after a media jam has been cleared, controller 114 (shown in FIG. 4) presumes that the components of media ejection system 300 are in some unknown, arbitrary position.

To calibrate, home and precisely move media ejection system 120 to a known position, controller 114 generates control signals directing rotary actuator 240 to supply a low level of torque at a low speed for a predetermined period of time to ensure that a lower range of motion for media ejection system 120 is reached such as when arm 138 engages datum stop 296. Because movement of media ejection system 120 to this lower range of motion occurs at a lower motor torque and low speed, arm 138 is not moved into contact with datum stop 296 with a destructively high amount of energy.

Once this lower range of motion has been established and detected (such as by an encoder of rotary actuator 240), controller 114 (shown in FIG. 5) generates control signals directing rotary actuator 240 to supply a high amount of torque at a high speed to rapidly move components of media ejection system 120 approximately 90% of the particular distance from the lower limit in which arm 138 contacts datum stop 296 as shown in FIGS. 9*a* and 10*a* to an upper limit of the estimated range of motion such as when arm 138 contacts datum stop 298 as seen in FIG. 12*a*. During this movement, high torque facilitates winding of spring 131 (shown in FIG. 5) and overcomes high loads due to lifting of claw assembly 132 to the retracted position.

For the final 10% of the predicted move from the lower limit of the range of motion to the upper limit of the range of motion, controller 114 generates control signals directing rotary actuator 240 to supply a medium level of torque at a medium speed for a predetermined time to cover the remaining estimated distance to the upper limit of the range of motion. The medium level of torque supplied by rotary actuator 240 reduces likelihood of arm impacting stop 298 with a destructively high amount of energy.

Each of the aforementioned steps is repeated to further stabilize motions and normalize deflections. During such movement, travel distance between the upper range of motion and the lower range of motion is measured by an encoder and saved by controller 114. The upper range of motion location is defined as the retracted position, the lower range of motion is defined as the ejecting position and a predefined fraction of distance between the upper limit of the range of motion and the lower limit of the range of motion is defined as the cam disengaged position. Using such information, controller 114 may generate control signals to reliably position media ejection system 120 in one of the three positions. The aforementioned process enables rotary actuator 240 to employ an inexpensive, relatively course, low accuracy single-channel encoder.

During operation of printing system 100, controller 114 (shown in FIG. 4) may continuously calibrate media ejection system 120 each time the system moves from the ready mode (shown in FIGS. 11*a* and 11*b*) to the ejection mode (shown in FIGS. 9*a*, 9*b*, 10*a* and 10*b*). To move ejection system 120 from the ready mode to the ejection mode, controller 114 generates control signals directing rotary actuator 240 to provide a high level of torque at a relatively high speed for a duration so as to move the components of media ejection system 120 approximately 95% of the estimated distance from the current withdrawn position of cam follower 136 in the ready mode to the lower limit of the estimated range of motion such as when arm 138 contacts datum stop 296.

For the remaining approximately 5% of the move to the lower range of motion, controller 114 (shown in FIG. 13) generates control signals directing rotary actuator 240 to supply a low level of torque for a sufficient duration to provide a gentle but definite contact between arm 138 and datum stop 296. The lower level of torque reduces destructive impact forces against datum stop 296 and establishes or zeroes the eject position for ejection system 120.

Subsequent return of ejection system 20 to the withdrawn position is achieved by controller 114 generating control signals directing rotary actuator 240 to supply a high level of torque for a high speed based upon the new zero location established for the lower range of motion. Since this calibration process is repeated for every sheet during printing, system 120 is continuously calibrated, enabling the use of inexpensive, relative course, electronically noisy and low accuracy single-channel encoders as part of rotary actuator 240.

Overall, media ejection system 120 offers several benefits. Media ejection system 120 utilizes a dual-pivot rotational motion against cam 134 to place system 120 in one of three operating states, allowing sheets to pass multiple times through and relative to printing mechanism 110. Because ejecting system 120 permits claws 164 to be moved to a retracted position within or behind shield 128, repair, maintenance and clearance of media jams is facilitated. Because system 120 employs a single claw holder or support 162 to position all claws 164, claw tip location variation is reduced. In addition, assembly time and part count is also reduced. A media ejection system 120 further facilitates use of a start-up calibration routine and a continuous calibration routine that facilitates accurate positioning of the components utilizing a simple and relatively inexpensive motor and single channel encoder.

FIGS. 13-19 illustrate printing system 300, another embodiment of printing system 100 shown in FIG. 4. Printing system 300 is similar to printing system 100 except that printing system 300 includes media ejection system 320 in lieu of media ejection system 120. For ease of illustration, those remaining elements or components of printing system 300 which correspond to elements of printing system 100 are numbered similarly.

Figure 13:
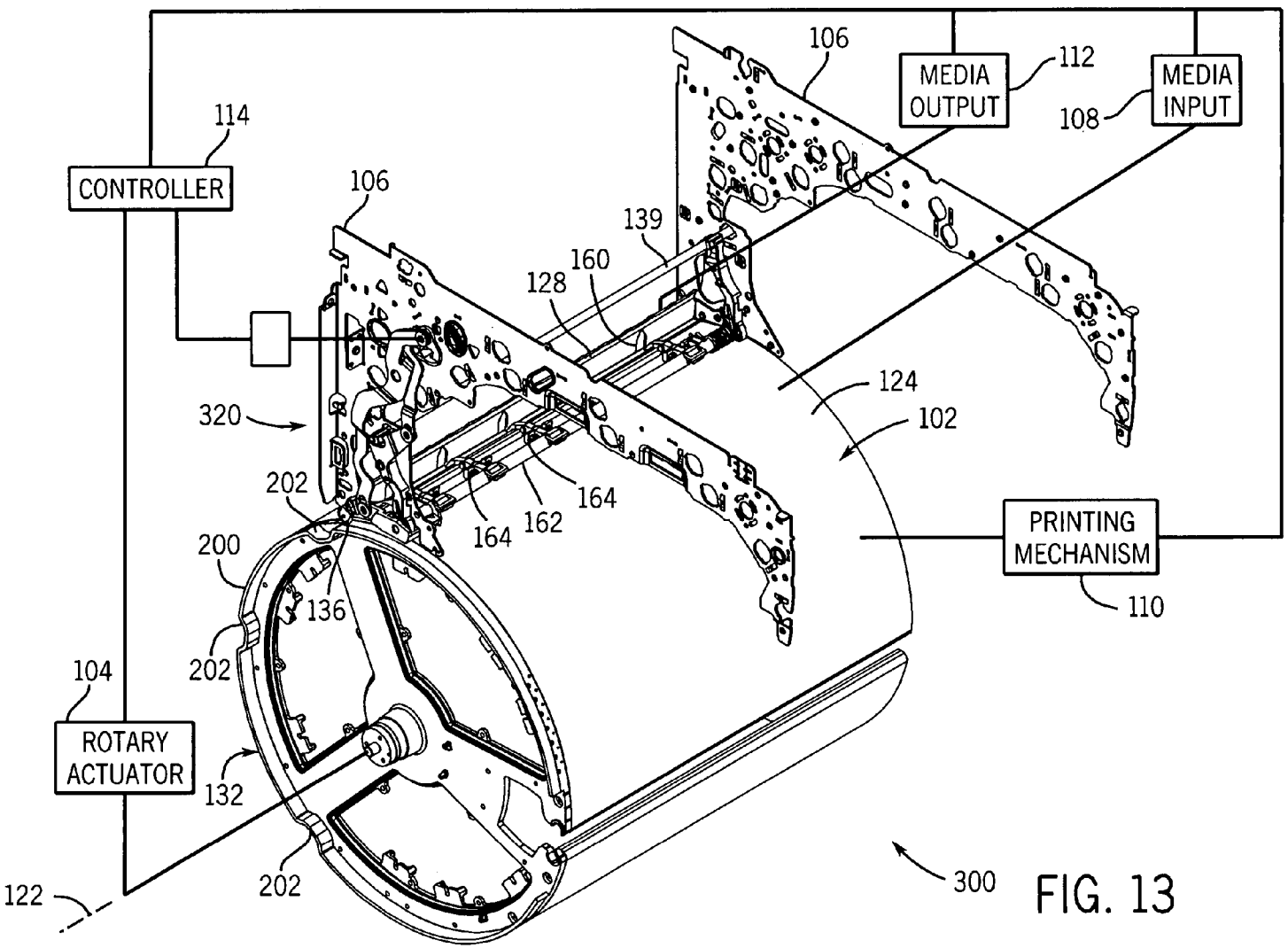
FIG. 13 is a top perspective view of another printing system including another embodiment of the media ejection system of FIG. 4 according to an example embodiment.
Figures 14, 15:
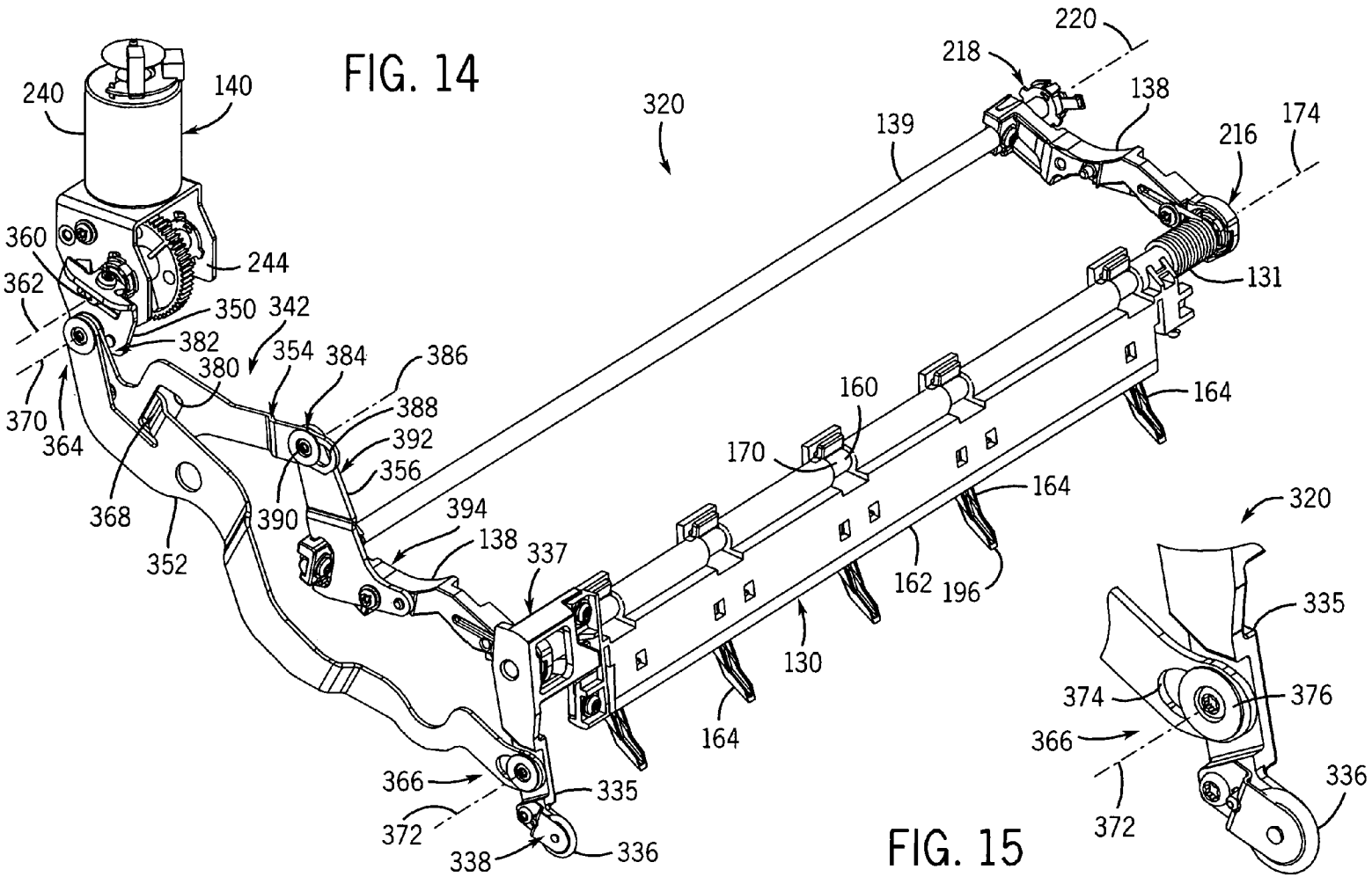
FIG. 14 is an enlarged perspective view of the media ejection system of FIG. 13 according to an example embodiment.
FIG. 15 is an enlarged fragmentary perspective view of a portion of the media ejection system of FIG. 14 according to an example embodiment.

Media ejection system 320, shown in FIGS. 13 and 14, is similar to media ejection system 120 except that media ejection system 320 includes lever 335, cam follower 336, and linkage assembly 342 in lieu of cam 134, lever 135, cam followers 136, 137, and pivot drive 242. Those remaining elements of media ejection system 320 which correspond to elements of media ejection system 120 are numbered similarly.

Figure 16:
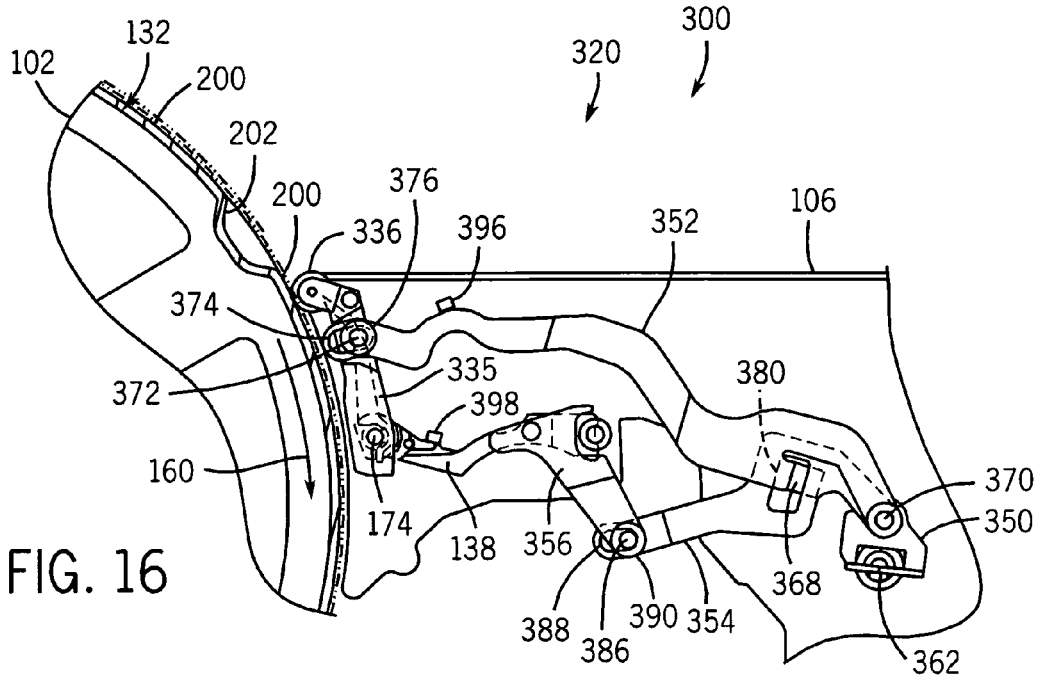
FIG. 16 is a sectional view of the printing system of FIG. 13 illustrating a cam follower and cam in a non-ejecting position during the ejection mode according to an example embodiment.
Figure 17:
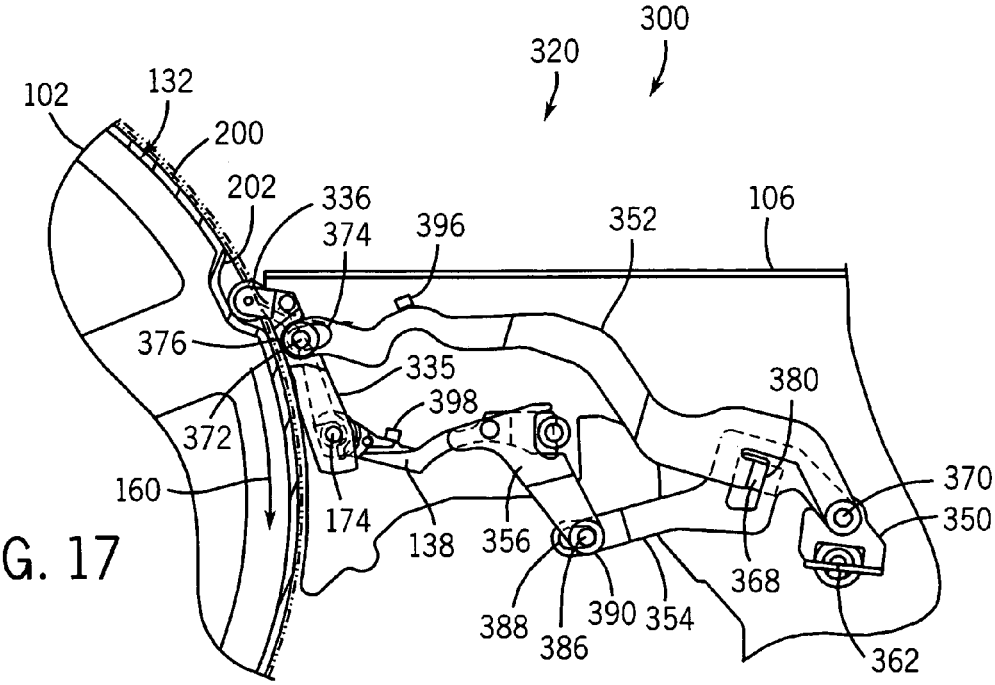
FIG. 17 is a sectional view of the printing system of FIG. 13 illustrating the cam follower and cam in the ejecting position during the ejection mode according to an example embodiment.

Lever 335 may comprise an elongated member having a first end 337 fixedly coupled to support shaft 161 such that lever 335 rotates or pivots about axis 174 with support shaft 161 and a second opposite end 338 rotatably supporting cam follower 336. Cam follower 336 may comprise a wheel, roller and the like, rotatably supported by lever 335 and configured to engage cam 132 (shown in FIG. 13) when media ejection system 320 is in the ejecting position as shown in FIGS. 16 and 17. Cam follower 336 rolls along surface portions 200 to maintain claws 164 in a non-ejecting position spaced from surface 124 of drum 102 as shown in FIG. 16. Upon cam follower 336 engaging a surface portion 202, cam follower 336 dips into surface portion 202 causing claws 164 to also dip or drop towards surface 124 for engagement with a sheet of media field by drum 102. Although cam follower 136 is illustrated as a roller, in other embodiments, cam follower 336 may alternatively comprise other movable or immovable structures coupled to lever 335 and configured to bear against cam 132 during rotation of drum 102.

Link assembly 342 may comprise an arrangement of links extending between rotary actuator 240 and pivot shaft 139 as well as lever 335. Link assembly 342 generally includes links 350, 352, 354 and 356. Link 350 may comprise a member fixedly coupled to an output shaft 360 of gear train 244 described above with respect to pivot drive 242 (shown in FIG. 5). Gear train 244 is coupled to an output shaft of rotary actuator 240 and transmits torque to link 350 via its output shaft 360. Link 350 rotates about axis 362 of output shaft 360 in response to torque supplied by rotary actuator 240.

Link 352 may comprise an elongated member having a first end 364, a second end 366 and an intermediate tab 368. First end 364 is pivotally connected to link 350 so as to pivot relative to link 350 about axis 370. End 366 pivotally connected to an intermediate portion of lever 335 such that link 352 and lever 335 may pivot or rotate relative to one another about an axis 372. FIG. 15 is an enlarged view illustrating end 366 connected to lever 335 in more detail. As shown by FIG. 15, end 366 includes an elongated slot 374 through which a boss 376 extends and is coupled to lever 335. Boss 376 and slot 374 cooperate to pivotally connect lever 335 and link 352. Slot 374 further enables axis 372 about which lever 335 and link 352 are pivoted to move within slot 374. Movement of boss 376 within slot 374 facilitates movement of claw assembly 130 between multiple states or positions as will be described in greater detail hereafter. Although boss 376 is illustrated as being coupled to lever 335 while slot 374 is formed in end 366 of link 352, in other embodiments, boss 376 may alternatively be coupled to end 366 of link 352 while slot 374 is formed in lever 335.

Tab 368 extends between ends 364 and 366 and is configured to be received within a corresponding aperture 380 in link 354. Tab 368 and aperture 380 and link 354 cooperate to control relative movement of links 352 and 354 and to transmit force between links 352 and 354 during movement of links 352 and 354. As with slot 374 and boss 376, tab 368 and aperture 380 facilitate movement of linkage assembly 342 to selectively position claw assembly 130 in one of multiple positions or states. Although tab 368 is illustrated as extending from link 352 and aperture 380 is illustrated as being provided in link 354, in other embodiments, tab 368 may alternatively extend from link 354 while aperture 380 is provided in link 352.

Link 354 may comprise an elongated linkage or member having an end 382 on a first side of aperture 380 and an opposite end 384 on a second opposite side of aperture 380. End 382 is pivotally connected to link 350 about axis 370. End 384 is pivotally connected to link 356 for pivotal movement about axis 386. As shown by FIG. 14, end 384 additionally includes an elongated slot 388 through which a boss 390 extends into connection with link 356 to pivotally connect end 388 of link 354 to link 356. Slot 388 enables axis 386 about which links 354 and 356 pivot relative to one another to move. Slot 388 further enables linkage assembly 342 to move to various positions or states so as to appropriately position claw assembly 130 in one of various states or positions. Although end 384 of link 354 is illustrated as including slot 388 and boss 390 is illustrated as being coupled to link 356, in other embodiments, slot 388 may alternatively be formed in link 356 while boss 390 extends through slot 388 and is connected to link 354. In still other embodiments, other mechanisms may be employed that facilitate pivotal connection of links 354 and 356 while permitting the axis of the pivotal connection to move.

Link 356 may comprise an elongated member having a first end portion 392 pivotally connected to link 354 as described above and a second end portion 394 fixedly coupled to pivot shaft 139 and arm 138. Link 356 transmits force from linkage assembly 342 to arm 138 so as to move arms 138 about pivot shaft axis 220 for positioning of claw assembly 130.

Figure 18:
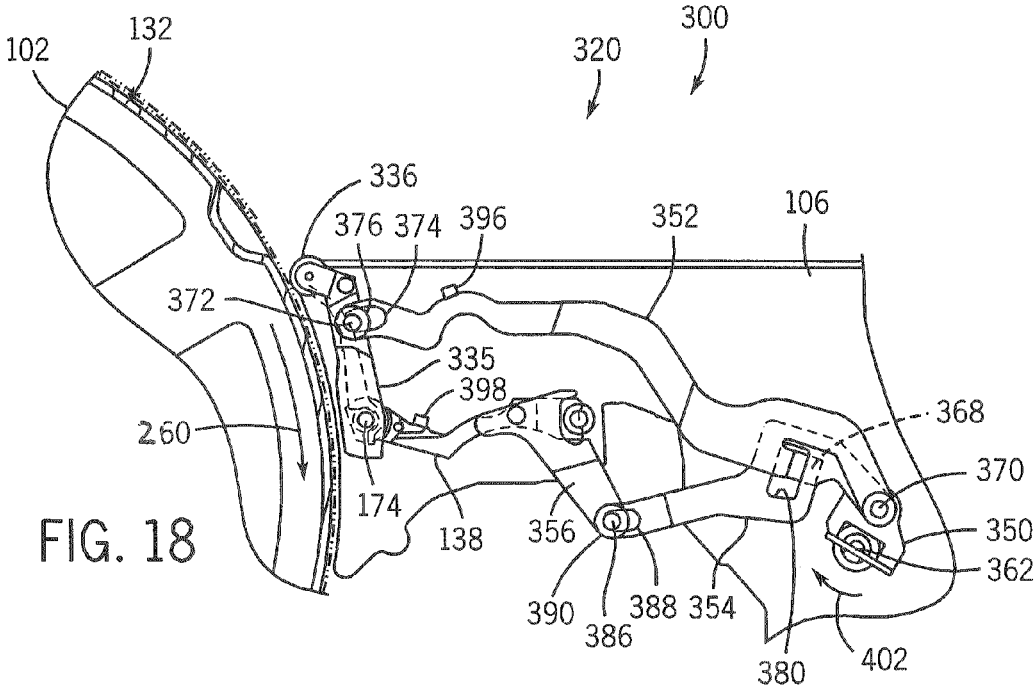
FIG. 18 is a sectional view of the printing system of FIG. 13 illustrating the cam follower and cam withdrawn from one another during the ready mode according to an example embodiment.
Figure 19:
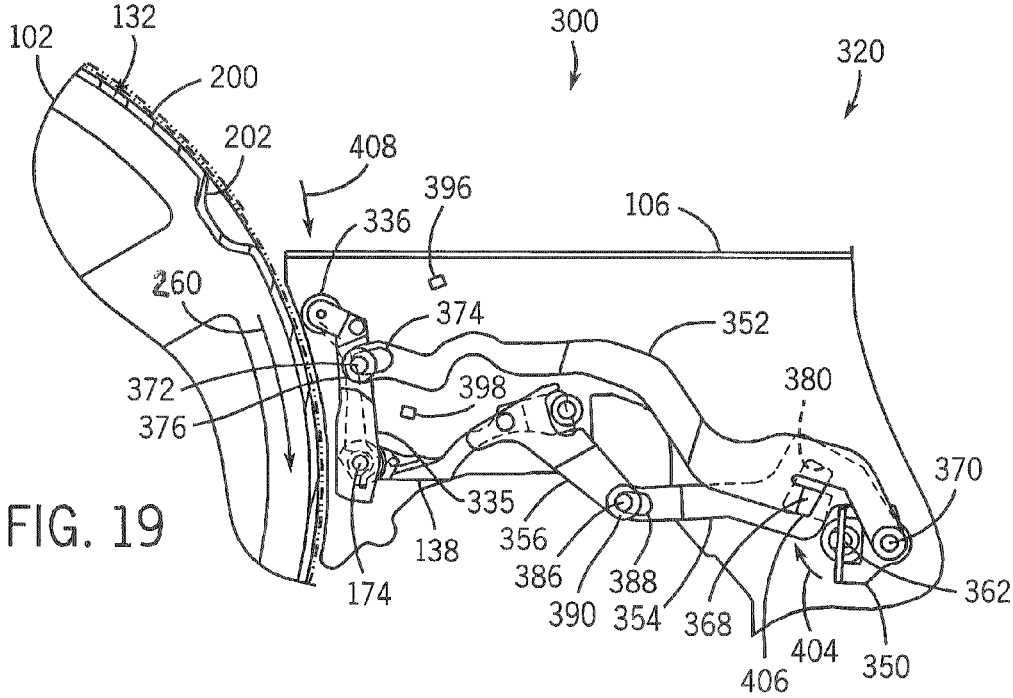
FIG. 19 is a sectional view of the printing system of FIG. 13 illustrating the cam follower and cam further retracted from one another during the shielding mode according to an example embodiment.

FIGS. 16-19 illustrate operation of media ejection system 320 to manipulate linkage assembly 342 so as to move lever 335, cam follower 336 and claw assembly 130 (shown in FIG. 14) between the ejection mode (shown in FIGS. 16 and 17), a ready, cam disengaged mode (shown in FIG. 18) and a retracted, shielded mode (shown in FIG. 19).

FIGS. 16 and 17 illustrate media ejection system 320 in a media ejection mode. In the ejection mode, rotary actuator 240 (shown in FIG. 14) supplies torque in a direction so as to rotate link 350 to the position shown until link 352 contacts datum stop 396 and until arm 138 contacts datum stop 398. Datum stops 396 and 398 comprise structures that are fixed or stationary with respect to drum 102 and with respect to linkage assembly 342. In one embodiment, datum stops 396 and 398 comprise projections extending from frame 106 (shown in FIG. 13). In the position shown in FIG. 16, link 354 is held in compression with boss 390 moved within slot 388 to shorten the effective length of link 354. At the same time, boss 376 is free to move within slot 374, allowing lever 335 to pivot about axis 174 in response to engagement of cam follower 336 with portions 200 and 202 of cam 132. In particular, as shown in FIG. 16, engagement of cam follower 336 with portion 200 of cam 132 results in boss 376 moving within slot 374 away from drum 102. As a result, claw assembly 130 is also moved away from drum 102 as shown in FIG. 16.

As shown in FIG. 17, in response to cam follower 336 in engagement with portion 202 of cam 132, boss 376 moves within slot 374 towards drum 102. As a result, claw assembly 130 and claws 164 are moved towards drum 102 such that tips 196 extend between media and drum 102 for separating the media from drum 102 as seen in FIG. 17.

FIG. 18 illustrates media ejection system 320 actuated to the ready state in which cam follower 336 is out of engagement with cam 132. To actuate media ejection system 320 to the cam disengaged mode shown in FIG. 18, rotary actuator 240 applies torque in appropriate directions so as to pivot link 350 to the position shown in FIG. 18. To actuate media ejection system 320 from the ejection mode shown in FIGS. 16 and 17, link 350 is pivoted about axis 362 in the direction indicated by arrow 402. When system 320 is in the ready mode withdrawn position shown in FIG. 18, boss 376 is in engagement with an end of slot 374 as shown. As a result, link 352 is placed in tension and lever 335 is pivoted about axis 174 until cam follower 336 is disengaged and withdrawn from cam 132. At the same time, link 350 is positioned such that boss 390 is moved within slot 388 such that link 354 is also in tension and is at its longest effective length.

FIG. 19 illustrates ejection system 320 in the retracted shielded mode in which claw assembly 130 (shown in FIG. 14) is retracted away from drum 102 to such an extent so as to inhibit physical contact with tips 196 of claws 164. To actuate media ejection system 320 to the shielded mode, rotary actuator 240 supplies torque in an appropriate direction so as to pivot link 350 to the position shown in FIG. 19. To actuate media ejection system 320 from the ready mode shown in FIG. 18 to the shielded mode shown in FIG. 19, rotary actuator 240 (shown in FIG. 14) pivots link 350 in the direction indicated by arrow 404. In the retracted position, tab 368 is moved within aperture 380 until engaging an opposite end of aperture 380 as compared to the withdrawn position shown in FIG. 18. The opposite end 406 of aperture 380 serves as a hard stop for pivotal movement of link 350 in the direction indicated by arrow 404. As shown by FIG. 19, when link 350 is in the position shown, lever 335, cam follower 336 and claw assembly 130 (shown in FIG. 14) are moved further away from drum 102 and are also moved in the direction indicated by arrow 408 such that tips 196 of claws 164 are retracted within or behind shield 128 as seen in FIG. 12*b*.

As discussed above, media ejection system 320 is actuated between the ejection mode (shown in FIGS. 16 and 17), the ready mode (shown in FIG. 18) and the retracted or shielded mode (shown in FIG. 19) based upon torque supplied by rotary actuator 240 (shown in FIG. 14). The duration for which rotary actuator 240 supplies torque, the amount of torque and the speed is in part based upon data obtained during a start-up calibration routine and continuous operation calibration routines. Upon start-up or initialization, which may occur after power cycling or after a media jam has been cleared, controller 114 (shown in FIG. 13) presumes that the components of media ejection system 300 are in some unknown, arbitrary position. To calibrate, home and precisely move media ejection system 320 to a known position, controller 114 generates control signals directing rotary actuator 240 to supply a low level of torque at a low speed for a predetermined period of time to ensure that a lower range of motion for media ejection system 320 is reached such as when arm 138 engages datum stop 398. Because movement of media ejection system 320 to this lower range of motion occurs at a lower motor torque and low speed, arm 138 is not moved into contact with datum stop 398 with a destructively high amount of energy.

Once this lower range of motion has been established and detected (such as by an encoder of rotary actuator 240), controller 114 (shown in FIG. 13) generates control signals directing rotary actuator 240 to supply a high amount of torque at a high speed to rapidly move components of media ejection system 320 approximately 90% of the particular distance from the lower limit in which arm 138 contacts datum stop 398 as shown in FIGS. 16 and 17 to upper limit of the estimated range of motion such as when tab 368 contacts end 406 of aperture 380 as seen in FIG. 19. During this movement, high torque facilitates winding of spring 131 (shown in FIG. 14) and overcomes high loads due to lifting of claw assembly 132 to the retracted position.

For the final 10% of the predicted move from the lower range of motion to the upper range of motion, controller 114 generates control signals directing rotary actuator 240 to supply a medium level of torque at a medium speed for a predetermined time to cover the remaining estimated distance to the upper limit of the range of motion. The medium level of torque supplied by rotary actuator 240 reduces likelihood of tab 368 impacting end 406 of apertures 380 with a destructively high amount of energy.

Each of the aforementioned steps is repeated to further stabilize motions and normalize deflections. During such movement, travel distance between the upper range of motion and the lower range of motion is measured by an encoder and saved by controller 114. The upper range of motion location is defined as the retracted position, the lower range of motion is defined as the ejecting position and a predefined fraction of distance between the upper range of motion and the lower range of motion is defined as the withdrawn position. Using such information, controller 114 may generate control signals to reliably position media ejection system 320 in one of the three positions. The aforementioned process enables rotary actuator 240 to employ an inexpensive, relatively course, low accuracy single-channel encoder.

During operation of printing system 300, controller 114 (shown in FIG. 13) may continuously calibrate media ejection system 320 each time the system moves from the ready mode (shown in FIG. 18) to the ejection mode (shown in FIGS. 17 and 18). To move ejection system 320 from the ready mode to the ejection mode, controller 114 generates control signals directing rotary actuator 240 to provide a high level of torque at a relatively high speed for a duration so as to move the components of media ejection system 320 approximately 95% of the estimated distance from the current withdrawn position of cam follower 336 in the ready mode to the lower limit of the estimated range of motion such as when arm 138 contacts datum stop 398.

For the remaining approximately 5% of the move to the lower range of motion, controller 114 (shown in FIG. 13) generates control signals directing rotary actuator 240 to supply a low level of torque for a sufficient duration to provide a gentle but definite contact between arm 138 and datum stop 398. The lower level of torque reduces destructive impact forces against datum stop 398 and establishes or zeroes the eject position for ejection system 320.

Subsequent return of ejection system 320 to the withdrawn position is achieved by controller 114 generating control signals directing rotary actuator 240 to supply a high level of torque for a high speed based upon the new zero location established for the lower range of motion. Since this calibration process is repeated for every sheet during printing, system 320 is continuously calibrated, enabling the use of inexpensive, relative course, electronically noisy and low accuracy single-channel encoders as part of rotary actuator 240.

Overall, media ejection system 320 offers several benefits. Like system 120, system 320 facilitates use of a continuous calibration which enables a simple and inexpensive electric motor and single channel encoder to initiate and home itself at power up and to precisely position the media ejection system 320 during printing. Like system 120, system 320 utilizes a single piece claw holder or support 162 to ensure accurate positioning and datuming of claws 164. Media ejection system 320 also reduces excessive backlash that would be present in an extended gear train, enabling faster transitions and greater positioning accuracy between the ejecting, withdrawn and retracted positions.

In addition, system 320 offers other benefits. System 320 reduces tension adjustment that would otherwise be required for a belt drive system, facilitating assembly and enhancing system reliability. Ejection system 320 also reduces the stress and deflection in components by reducing the amount of torque and gear reduction. The use of slots and links by media ejection system 320 forms three separate 4-bar linkages using only 4 links, reducing part count and assembly time.

Although systems 120 and 320 are illustrated as including claw assembly 130 in which a single claw support 162 (also known as a holder or a paw) supports multiple claws 164, in other embodiments, systems 120 and 320 may alternatively utilize other claw mounting arrangements. For example, in other embodiments, systems 120 and 320 may alternatively have claws 164 individually mounted to support shaft 161 without support 162. Although systems 120 and 320 are illustrated as being actuatable between an ejecting position, a withdrawn position and a retracted position, in other embodiments, system 120 or system 320 may alternatively be configured to move between fewer such positions or additional positions.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a drum configured to carry a sheet and rotate about an axis;

a first claw opposite the drum and configured to move between a sheet ejecting position and a non-ejecting position;

a cam coupled to the drum and configured to rotate about the axis; and a cam follower operably coupled to the first claw, wherein the first claw moves between the ejecting position and the non-ejecting position in response to engagement of the cam follower with the cam;

an actuation mechanism operatively coupled to the cam follower and configured to move the cam follower between a cam engaging position and a cam disengaging position;

a second cam spaced from the drum and having a first surface; and a second cam follower operably coupled to the first claw, wherein the cam follower moves between the cam engaging position and the cam disengaging position in response to engagement of the second cam follower with the first surface of the second cam, wherein the second cam includes a second surface oblique to the first surface and wherein the first claw moves from a first position having a first non-zero spacing from the drum to a second position having a second non-zero spacing from the drum greater than the first non-zero spacing in response to the second cam follower moving from the first surface to the second surface.

2. The apparatus of claim 1, wherein the cam comprises a circumferential surface about the axis, the surface including concavities configured to engage the cam follower to move the first claw to the ejecting position.

3. The apparatus of claim 1 further comprising a shield having apertures, wherein the first claw is movable through the shield.

4. The apparatus of claim 1 further comprising a shield, wherein the first claw is movable to a shielded position in which the shield extends between the first claw and the drum.

5. The apparatus of claim 1 further comprising a second claw movable with the first claw.

6. The apparatus of claim 1, wherein the claw is movable between the ejecting position and the non-ejecting position while the cam follower is in engagement with the cam.

7. The apparatus of claim 1, further comprising a printing mechanism configured to print on the sheet while the sheet is wrapped about the drum.

8. The apparatus of claim 1, wherein the drum includes a depression and wherein the claw has a tip configured to extend into the depression when in the ejecting position.

9. The apparatus of claim 1, wherein the cam is coupled to the drum so as to move in unison with rotation of the drum about the axis.

10. The apparatus of claim 1, wherein the cam is formed along a circumferential surface of the drum.

11. The apparatus of claim 1, wherein the cam follower comprises a roller.

12. The apparatus of claim 1, wherein the actuation mechanism comprises a motor.

13. The apparatus of claim 1 comprising at least three claws, including the first claw, operably coupled to the cam follower and axially arranged across the drum, each of the claws configured to move between the ejecting position and the non-ejecting position in response to engagement of the cam follower with the cam.

14. The apparatus of claim 1 wherein the second cam follower is movable out of engagement with the second cam.

15. The apparatus of claim 1, wherein the first cam follower and a second cam follower each comprise a roller.

16. The apparatus of claim 1 further comprising a shield, wherein the second cam includes a second surface and wherein the first claw moves from an extended position in which the first claw extends through the shield to a shielded position in which the shield extends between the first claw and the drum in response to engagement of the second cam follower with the second surface of the second cam.

17. The apparatus of claim 1, wherein the second cam follower pivots about a first axis and a second axis during movement of the second cam follower against the first surface and the second surface of the second cam.

18. The apparatus of claim 1, wherein the cam continuously extends around the drum.

19. The apparatus of claim 1 further comprising a shield, wherein the actuation mechanism is configured to move the first claw independent of any print media from an extended position in which the first claw extends through the shield to a shielded position in which the shield extends between the first claw and the drum.

20. The apparatus of claim 1, wherein the actuation mechanism includes a rotary actuator, a pivot drive and a lever couple to the claw, wherein the pivot drive transmits torque from the rotary actuator to the lever to pivot the lever to move the second cam follower against the second cam.

21. The apparatus of claim 1, wherein rotation of the drum moves the cam relative to and beneath the second cam.

22. The apparatus of claim 1, wherein the second cam is stationarily supported independent of rotation of the drum about the axis.

23. The apparatus of claim 1 further comprising a frame, wherein the second cam is supported by the frame.

24. The apparatus of claim 1, wherein the second cam includes a linear ramp against which the second cam follower contacts to move the cam follower out of engagement with the cam.

25. The apparatus of claim 10, wherein the cam extends along an axial end of the drum.

26. The apparatus of claim 16, wherein the first claw extends through the shield when the second cam follower is in engagement with the first surface of the second cam.

27. The apparatus of claim 16, wherein the first claw linearly moves from the extended position to the shielded position as the second cam follower moves along the second surface of the second cam.

28. The apparatus of claim 19, wherein the actuation mechanism includes a rotary actuator, a pivot drive and a lever couple to the claw, wherein the pivot drive transmits torque from the rotary actuator to the lever to pivot the lever to move the claw.

29. An apparatus comprising:

a drum configured to carry a sheet and rotate about an axis;

a first claw opposite the drum and configured to move between a sheet ejecting position and a non-ejecting position;

a cam coupled to the drum and configured to rotate about the axis; and a cam follower operably coupled to the first claw, wherein the first claw moves between the ejecting position and the non-ejecting position in response to engagement of the cam follower with the cam;

an actuation mechanism operatively coupled to the cam follower and configured to move the cam follower between a cam engaging position and a cam disengaging position;

a second cam spaced from the drum and having a first surface;

a second cam follower operably coupled to the first claw, wherein the cam follower moves between the cam engaging position and the cam disengaging position in response to engagement of the second cam follower with the first surface of the second cam; and a shield, wherein the second cam includes a second surface and wherein the first claw moves from an extended position in which the first claw extends through the shield to a shielded position in which the shield extends between the first claw and the drum in response to engagement of the second cam follower with the second surface of the second cam.

* * * * *

UNITED STATES PATENT AND TRADEMARK OFFICE

CERTIFICATE OF CORRECTION

PATENT NO. : 7,594,721 B2
APPLICATION NO. : 11/263136
DATED : September 29, 2009
INVENTOR(S) : Jason S. Belbey et al.

It is certified that error appears in the above-identified patent and that said Letters Patent is hereby corrected as shown below:

In column 10, line 10, below "followers 136 and 137." insert -- Cam follower 136 may comprise a member configured to bear against cam 132 when cam follower 136 is in the ejecting position. In the particular example illustrated, cam follower 136 may comprise a wheel or roller rotatably supported by lever 135. In other embodiments, cam follower 136 may comprise other movable or immovable structures configured to bear against cam 132. -- as a new paragraph.

Signed and Sealed this

Sixteenth Day of November, 2010

David J. Kappos

David J. Kappos
*Director of the United States Patent and Trademark Office*